US005979348A

United States Patent [19]

Yaguchi

[11] Patent Number: 5,979,348

[45] Date of Patent: Nov. 9, 1999

[54] ROLLED HEM FORMING PROCESS AND APPARATUS THEREFOR

[75] Inventor: Jinichi Yaguchi, Kani, Japan

[73] Assignee: Barudan Sewing Machine Co., Ltd., Ichinomiya, Japan

[21] Appl. No.: 09/202,510

[22] PCT Filed: Jun. 19, 1997

[86] PCT No.: PCT/JP97/02120

§ 371 Date: Dec. 15, 1998

§ 102(e) Date: Dec. 15, 1998

[87] PCT Pub. No.: WO97/48847

PCT Pub. Date: Dec. 24, 1997

[30] Foreign Application Priority Data

Jun. 20, 1996 [JP] Japan ..... 8-159636

[51] Int. Cl.[6] ..... D05B 35/02

[52] U.S. Cl. ..... 112/475.16; 112/470.16; 112/141; 493/405; 223/37

[58] Field of Search ..... 112/475.06, 470.16, 112/141, 143, 235, 152, 136; 493/405, 446, 455, 459; 223/37

[56] References Cited

U.S. PATENT DOCUMENTS 1,943,801 1/1934 Mueller ..... 112/141

3,776,156 12/1973 Morgan ..... 112/141

4,517,907 5/1985 Franke, Sr. ..... 112/470.16

*Primary Examiner*—Peter Nerbun

*Attorney, Agent, or Firm*—Hale and Dorr LLP

[57] ABSTRACT

A rolled hem forming process and a rolled hem provider incorporating the process are disclosed. The process eliminates use of a conventional truncated pipe which is capable of properly forming a rolled portion on only certain types of fabric materials. The process of the invention is capable of securely and smoothly forming a rolled portion on virtually any type of fabric material, thick or thin, or undulated or not undulated. The process utilizes the steps of (*a*) rounding an outer portion (42*a*) and middle portion (42*b*) on an arc guide body (15) with a rounding plate (21), (*b*) further rounding the outer and middle portions (42*a*, 42*b*) with a rolling device (22), (*c*) positioning a second plate (13) within the outer and middle portions (42*a*, 42*b*), (*d*) folding the outer portion (42*a*) onto the second plate (13) with a bending device (23), and (*e*) folding the outer and middle portions (42*a*, 42*b*) onto an inner portion (42*c*) with a curved guide surface (13*a*) of the second plate (13) to provide a rolled portion (41) on a hem portion (42).

2 Claims, 28 Drawing Sheets

Prior Art

20=21+22+23+24

(A)

(B)

Prior Art

ROLLED HEM FORMING PROCESS AND APPARATUS THEREFOR

FIELD OF THE INVENTION

This invention generally relates to "three-fold" rolled hem forming on an elongated fabric and an apparatus therefor.

BACKGROUND ART

Generally, an elongated fabric material is used for producing fabric products for an elongated fabric material provides more efficient and economical yield than a short fabric material. The edges or hems of an elongated fabric material require hemming to prevent fraying as well as provide a neat appearance.

Japanese Patent Publication No. 57-17554 disclosed an automatic hemming machine for an elongated fabric material, Japanese Patent Publication No. 59-5155 disclosed a hemming apparatus anti Japanese Patent Publication No. 62-19873 disclosed a s.ewing machine with a zigzag controller, all proposed for hemming an elongated fabric material. These prior art apparatus cannot appropriately process the edges or hems for all types of fabric products. Flat fabric products such as scarves, curtains, Japanese style wrapping cloths and towels are conventionally hemmed as schematically shown in FIG. 27 (B) by means of folding a hem portion in three layers, which cannot always be readily and easily performed with a conventional apparatus.

For conventionally forming a hem portion of a fabric material into a layered configuration, a truncated multi-pipe device as shown in FIG. 28 is utilized. A hem portion of an elongated fabric material is fed into the pipe device in the direction shown by an arrow toward a hem stitching machine (not shown) for three-fold rolled hemming as shown in FIG. 27 (B).

Such a truncated pipe device as shown in FIG. 28 may be conveniently utilized to automatically and speedily provide a layered hem portion on a thin and smooth elongated fabric material, however, this hemming method does not adequately apply for processing a thick or undulated fabric material such as one for towels. As shown in FIG. 27 (A), a fabric material 40 for producing towels is an elongated fabric sheet material having piled sections Pa which are separated by non-piled zones along imaginary lines L for cutting. The hem portions of such a fabric material 40 are not uniform in thickness and cannot be readily and smoothly fed into the truncated pipe device.

As FIG. 27 (A) shows, the towel material is provided with fabric sections or regions each having a different thickness. Regions Pa are provided with piles while regions Ta and Tb are plainly woven and have different thicknesses. Regions Ta for providing an aesthetic appearance are to be cut in the center along imaginary lines L. Regions Ta are made thicker than regions Tb and regions Pa are the thickest. Thus the surfaces of the fabric material 40 are undulated.

It is ha;rd to smoothly feed such an undulated towel material 40 into a truncated pipe device for rolled or layered hemming with a hem stitching machine. In addition, the width of the hem portion to be stitched is generally only 5 mm–10 mm, which adds difficulty to partially feeding an elongated fabric material through a truncated pipe device, for a high-speed hemming operation in particular. The truncated pipe device may be enlarged to process a thick or undulated fabric material, however, such an enlarged pipe device then cannot process a thin fabric material adequately.

International Publication No. 92/09734 disclosed a rolled heming apparatus, which processes a hem portion 42 of an elongated fabric material 40 following the steps shown in FIG. 3 (B) (prior art) to provide a layered portion 41 on the hem as shown in step 5. The hem portion 42 consisting of an outer hem portion 42*a*, middle hem portion 42*b* and inner hem portion 42*c* is folded in steps 1–5 to finally provide a layered hem portion 41 in step 5.

According to the disclosed apparatus, it is required to first lift upward the portions 42*a* and 42*b* together as shown in step 2, bend the portion 42*a* inward at a right angle in step 3, bend it again downward in step 4 at a right angle and bend the portion 42*b* at a right angle together with the portion 42*a* onto the portion 42*c* as shown in step 5 to provide a three-layer hem portion 41, which generates considerable mechanical stress onto the apparatus, especially when done at a high speed, possibly causing not only trouble to or malfunctioning of the apparatus but displeasing appearance to the product.

A fabric possesses a degree of shape restoration or repulsion. A fabric material for producing towels has a considerable thickness, which increases the restoration moment. The steps shown in FIG. 3(B) will not be adequately and smoothly carried out on such a thick fabric material as the bent fabric portions, especially when the bent portions are narrow, will generate considerable shape restoration moment.

Accordingjly, it is an object of the present invention to provide a rolled hem forming process that can speedily and smoothly form a three-layer rolled portion 41 on a hem portion 42 of an elongated fabric material 40, thin or thick, by utilizing rounding and pressing means, and not conventional bending or folding means or a conventional truncated multi-piped device, and that without exerting much stress onto the apparatus. It is another object of the present invention to provide a rolled hem forming device utilizing such a process.

DISCLOSURE OF THE INVENTION

As stated in the above, it is an object of the present invention to provide a swift and reliable formation of a rolled hem portion along a hem of an undulated and/or thick elongated fabric material for hemming. Said object of the present invention can be achieved by substantially eliminating shape restoration repulsion of the hem portion being prepared for rolled hemming.

A process as claimed in claim 1 provides a swift hem preparation of an elongated fabric material, thick or thin, and/or undulated or not, by substantially eliminating shape restoration repulsion of the hem portion.

Such a process of claim 1 can be incorporated into a rolled hem provider as claimed in claim 2.

A process to provide a rolled hem on an elongated fabric according to claim 1, which generates only a minimum fabric restoration repulsion, is provided as follows. An elongated fabric sheet 40 is provided with a rolled hem portion 41 which is formed from a hem portion 42 consisting of an outer hem portion 42*a*, middle hem portion 42*b* and inner hem portion 42*c*. The fabric sheet 40 is thereafter fed into a stitching device 210, in the steps:

(1) rounding the outer hem portion 42*a* and the middle hem portion 42*b* by a rounding plate 21 on an arc guide body 15;

(2) further rounding the outer portion 42*a* and the middle portion 42*b* with a rolling device 22 on the guide body 15;

(3) positioning a second plate 13 provided on she guide body 15 within the rounded portions 42*a* and 42*b* and a first plate 12 on the inner portion 42*c;*

(4) pressing the outer portion 42*a* onto the second plate 13 with a bending device 23; and (5) pressing together the outer portion 42*a* and the middle portion 42*b* sandwiching the second plate 13 onto the first plate 12 positioned on the inner portion 42*c* with a curved guide surface 13*a* of the second plate 13, to provide a rolled portion 41 on the hem portion 42.

The outer hem portion 42*a* and middle hem portion 42*b* are first rounded not folded, to provide a half rounded fabric portion as shown in step 1 of FIG. 3(A), within which the second plate 13 is inserted and the first plate 12 is placed on the inner hem portion 42*c* in step 2. The outer portion 42*a* is pressed onto the second plate 13 in step 4, which is turned 90 degrees inwardly to be laid on the first plate 12 on the inner portion 42*c* to provide a layered formation 41 as shown in step 5 of FIG. 3(A).

The outer portion 42*a* and the middle portion 42*b* are not bent at aright angle as shown in steps 2–4 of FIG. 3(B). Instead, they are rounded as shown in steps 1 and 2 of FIG. 3(A), thus the fabric repulsion is effectively reduced, enabling a speedy, smooth and reliable forming of a rolled hem portion 41 without generating much stress onto a machine which incorporates the inventive process.

After rounding of the outer portion 42*a* and middle portion 42*b* is complete, the second plate 13 is placed within the cylindrical formation of the outer portion 42*a* and middle portion 42*b*. The outer portion 42*a* is then pressed onto the second plate 13 such that the second plate 13 is sandwiched between the outer and middle portions 42*a* and 42*b*. The first plate 12 is concurrently placed on the inner portion 42*c* as shown in step 4 of FIG. 3(A).

The right-angle bending of a fabric material as shown in steps 2 and 3 of FIG. 3(B) is replaced with a rounding of a fabric material, greatly reducing the shape restoration repulsion or force. Accordingly, the outer portion 42*a*, middle portion 42*b* and inner portion 42*c* can be layered smoothly and neatly to provide a neat three-layer hem portion 41, substantially without generating much mechanical stress onto the machine.

The fabric material 40 with a hem portion 42 configured as shown in step 4 of FIG. 3(A) along the first and second plates 12 and 13 and processed in step 5 of FIG. 3(A) for forming a three-layer rolled portion 41 is continuously driven forward to be provided with an elongated rolled configuration 41, from which the first and second plates 12 and 13 are removed for provision of hemming of the rolled portion 41.

The hem portion 42 is actually processed as shown in FIGS. 4 and 5. The hem portion 42 of the fabric material 40 is sent towards the upper right in FIG. 4. In step 1 of FIG. 5, the outer portion 42*a* of the hem portion 42 is lifted along a roll core device 10 and then rounded with a rolling device 22 in step 2. After that, the outer portion 42*a* is pressed against an arch guide body 15 in steps 2 and 2'.

The first plate 12 and second plate 13 are positioned on the distal end of the arc guide body 15. As the hem portion 42 is sent forward from step 2, the inner portion 42*c* is pressed by the first plate 12 and the second plate 13 is positioned between the outer portion 42*a* and middle portion as shown in step 3 of FIG. 5.

The hem portion 42 is further sent forward to step 4, where the arc guide body 15 is detached. Instep 4, the outer portion 42*a* is pressed onto the second plate 13 by means of the bending device 23. The second plate 13 where the middle portion 42*b* is pressed by the bending device 23 brings the outer portion 42*a* and middle portion 42*b* onto the first plate 12 rested on the inner portion 42*c* as shown in step 5 of FIG. 3(A).

As described, the outer portion 42*a* and middle portion 42*b* are successively rounded and pressed onto the inner portion 42*c*, thus effectively eliminating shape restoration stress of the hem portion 42. The first and second plates 12 and 13 are advantageously made of an elastic material to reduce mechanical stress and damage to the fabric portion 42.

Accordingly, the present invention provides a three-layer hem portion 41 on an elongated fabric sheet, either flat or undulated, very reliably at a high speed.

A rolled hem provider 100 according to the present invention as claimed in claim 2 is utilized in a hemming device 200 having a stitching device 210 which hems the rolled hem portion 41 of an elongated fabric material 40. The rolled hem provider 100 includes a roll core device 10 positioned in parallel with the hem portion 42 of the fabric sheet 40, and a guide apparatus 20 positioned around the roll core device 10.

The core device 10 includes a core body 11 having a press surface 14 to press the inner portion 42*c* from above, an arc guide body 15 unitarily provided with a surface of the core body 11 facing the hem portion 42 to provide an arc surface, a first plate 12 having a surface associated with the press surface 14, and a second plate 12 having a curved guide surface 13*a*, an end of which is attached on the distal end of the arc guide body 15 at a right angle with the press surface 14 of the core body 11 and the other end of which is positioned in parallel with the press surface 14.

The rolled hem provider 100 further includes a guide apparatus 20 which includes a rounding plate 21 to fold the middle portion 42*b* of the hem portion 42 onto the arc guide body 15, a rolling device 22 to fold the outer portion 42*a* of the hem portion 42 onto the arc guide body 15, and a bending device 23 to fold the outer portion 42*a* along the second plate 13.

The rolled hem provider 100 of the present invention is positioned between the stitching device 210 of the hemming apparatus 200 and a feeder 220 as shown in FIGS. 1 and 2, having the roll core device 10 which acts an important role in forming a rolled portion 41 of the fabric material 40 and the guide apparatus 20 which assists the function of the core device 10.

Generally, a rolled hem provider 100 is installed on each side of an elongated fabric material 40 to provide a rolled hem portion 41 on each hem portion 42 of the fabric material 40. Each of the rolled hem providers 100 provides a rolled hem portion 41 along ahemportion 42 of the fabric 40 by rolling the respective outer portion 42*a*, middle portion 42*b* and inner portion 42*c* and provides a layered portion 41, which is fed to a stitching device 210 to provide a stitched rolled hem 41 as shown in FIG. 27(B).

The rolled hem provider 100 utilizes a support table 30 attached to a hemming apparatus 200 placed in front of the stitching device 210. Attached to the support table 30 are the roll core cevice 10 and the guide apparatus 20 which holds the hem portion 42 of the fabric material 40 against the core device 10. The roll core device 10 utilizes the core body 11, the arc guide body 15, the first plate 12 and the second plate 13.

The guide apparatus 20 utilizes a rounding plate 21, a rolling device 22, a bending device 23 and a rolled portion holder 24. They are positioned relative to the core device 10 as shown in FIGS. 4, 7 and 9.

The outer portion 42*a* of the hem portion 42 is first rounded by the rounding plate 21 which presses the outer portion 42*a* against the outer surface of the arc guide body 15 of the core device 10. The middle portion 42*b* together with the outer portion 42*a* is pressed against the arc guide body 15 by the rolling device 22. The second plate 13 is inserted within the rounded portions 42*a* and 42*b* (between the rolling device 22 and bending device 23 in FIG. 4). The inner portion 42*c* is pressed with the first plate 12.

The first plate 12 and second plate 13 are positioned at right angles relative to each other. In the center of the second plate 13 is positioned the bending device 23. The bending device 23 and the curved guide surface 13*a* of the second plate 13 guide. the outer portion 42*a* and middle portion 42*b* onto the inner portion 42*c* (see FIG. 3 and step 3 of FIG. 5).

The first. plate 12 and second plate 13 are then removed from the rolled hem portion 41. A rolled portion holder 24 places the roll.ed portion 41 of the hem portion 42 on the support table 30, which is sent to the stitching device 210.

The curved guide surface 13*a* of the second plate 13 is a portion on the second plate 13 which guides the hem portion 42 of the fabric material 40. The curved surface 13*a* may be a plain surface as well.

The hem portion 42 of the fabric material 40 must always be held within the rolled hem provider 100 to be provided with a proper rolled portion 41. The following measures can be taken to keep the hem portion 42 within the rolled hem provider 100:

1) A number of protruding rails extending from the proximal inner side to the distal outer side can be provided on the lower press surface 14 of the core body 11 of the core device 10. These rails make sure that the inner portion 42*c* of the hem portion 42 is securely guided toward outside so as to be held within rolled hem provider 100;
2) A nurturer of protruding rails can be provided extending from the proximal inside to the distal outside under the core body 11 so as to securely guide the inner portion 42*c* toward outside as in measure 1;
3) A number of protruding rails can be provided extending from the proximal underside to the distal upper side on the outside surface of the arc guide body 15 of the core device 10. The middle portion 42*b* is securely pulled upward to hold the hem portion 42 within the rolled hem provider 100;
4) A number of guide rails such as guide rails 23*e* can be provided on the surface of the rolling device 22 or other members of the guide apparatus 20 which faces the hem portion 42. The middle portion 42*b* is securely pulled upward and
5) Measures 1–4 may be utilized in a selected combination.

BEST MODE TO CARRY OUT THE INVENTION

The rolled hem forming process of the present invention as claimed in claim 1 is incorporated in the rolled hem provider 100 as claimed in claim 2. Accordingly, the rolled hem provider 100 is described hereinafter in detail using the accompanying drawings, which will describe the process of the present invention as well.

Figure 1:
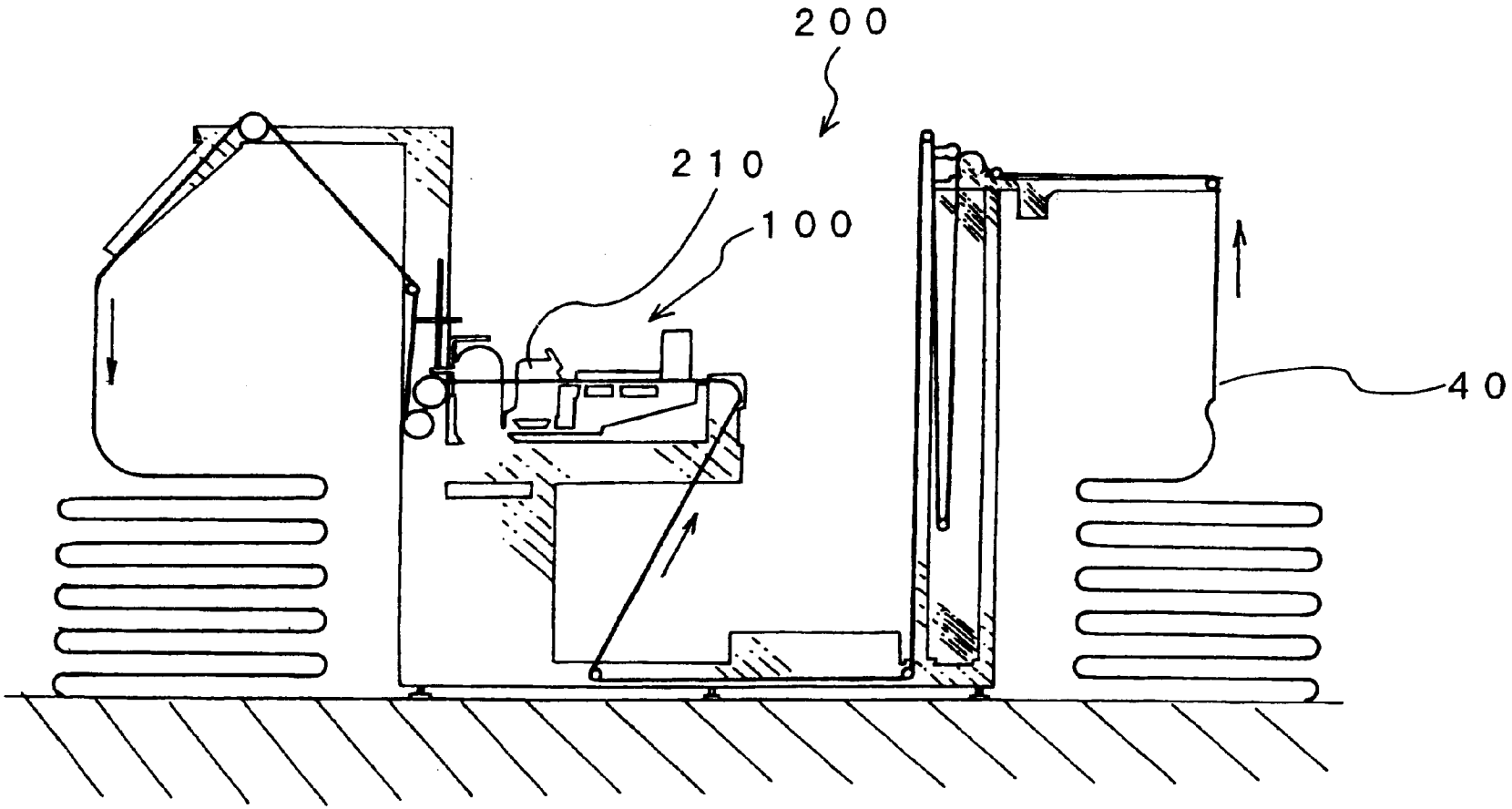
FIG. 1 is a side view of a hemming apparatus incorporating a rolled hem provider of the present invention.
Figure 2:
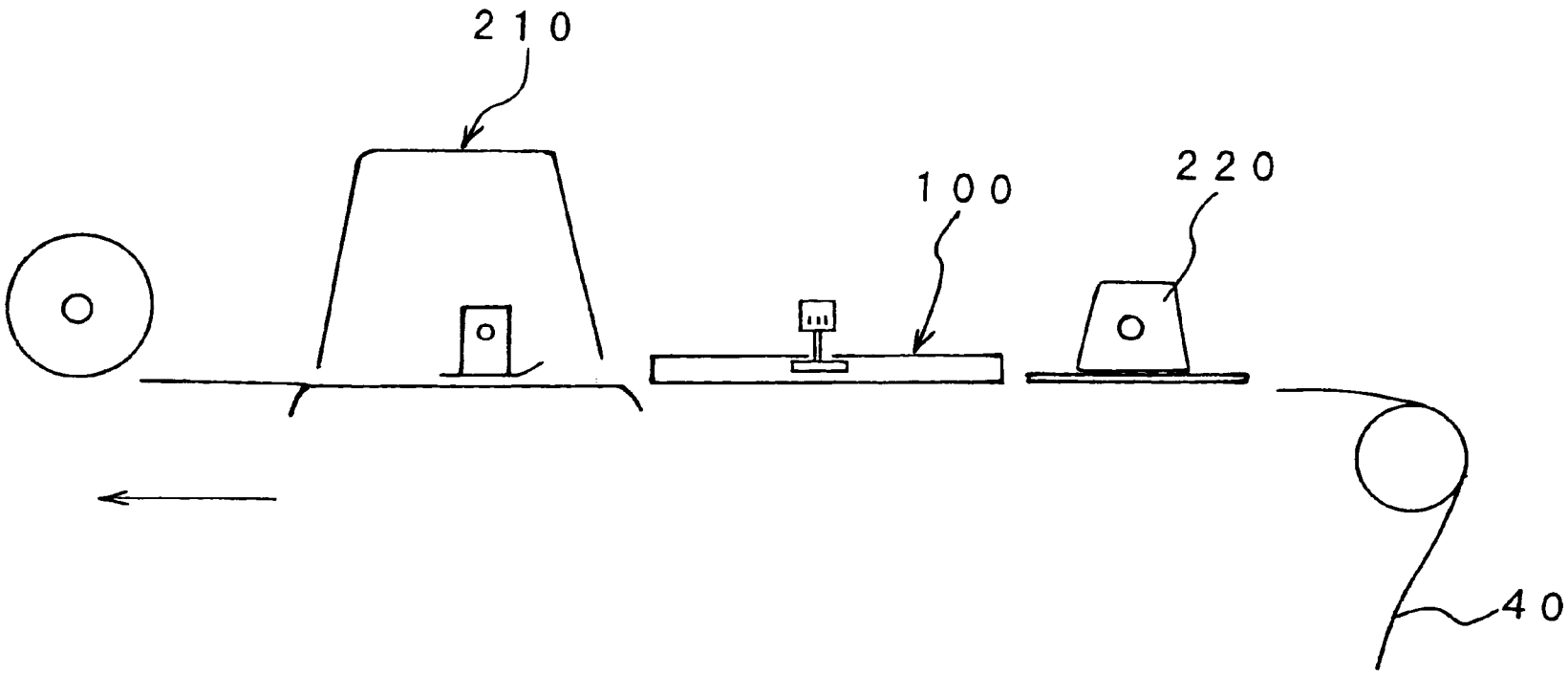
FIG. 2 is a partial schematic view of the hemming apparatus.
Figure 3:
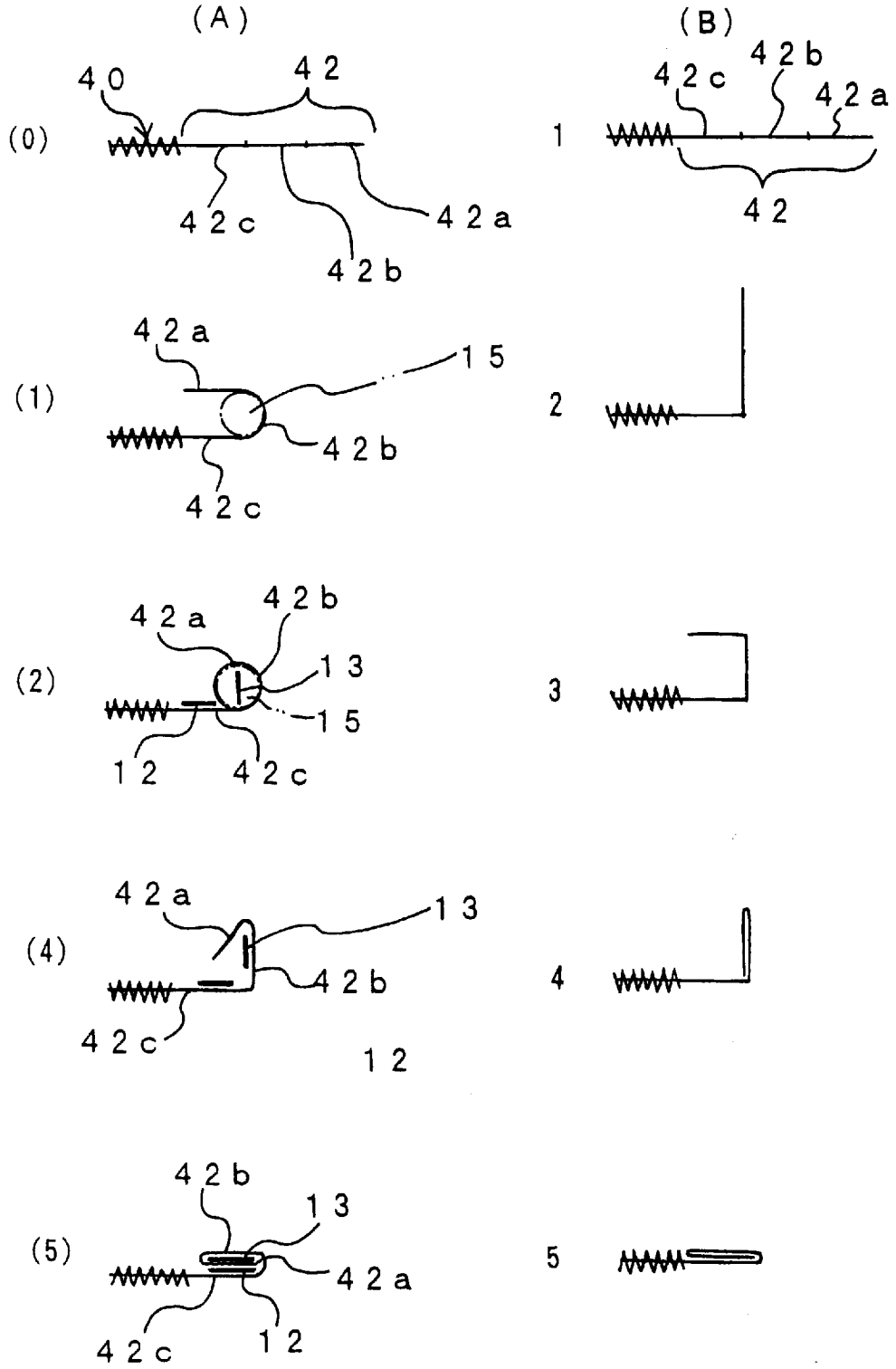
FIG. 3 shows a comparison between the steps taken by the present invention and conventional steps, wherein (A) is directed to the present invention and (B) is directed to the conventional process, showing how the orientation of the outer portion, middle portion and inner portion of a hem portion changes.

The rolled hem provider 100 is placed between a stitching device 210 of a hemming apparatus 200 and a feeder 220 as schematically shown in FIGS. 1 and 2. Advantageously, two providers 100 are installed along both hems of an elongated fabric material 40. The fabric material 40 is sent by the feeder 220 in the direction shown in FIGS. 1 and 2 by arrows to be processed by the rolled hem provider 100 a nd stitched by the stitching device 210.

The hemming apparatus 200 is now described, which includes the rolled hem provider or providers 100 and the feeder or feeders 220. As shown in FIGS. 1 and 2, the hemming apparatus 200 feeds the fabric material 40 after formation of an elongated rolled portion 41 to the stitching device 210. Before the fabric material 40 is sent to the stitching device 210, the fabric 40 is processed through the rolled hem provider (s) 100 as shown in FIG. 2. The feeder 220 located before the rolled hem provider 100 trims and feeds the fabric material 40 to the rolled hem provider(s) 100. Hereinafter, for he convenience of description, a provider 100 can also signify two providers 100.

A support table 30 is additionally provided to the hamming apparatus 200 for positioning and pressing adjustment.

The roll core device 10 includes, as shown in FIG. 21(A) and (B), a press surface 14 which presses the inner portion 42*c* of the hem portion 42, a core body 11 provided at a right angle with the press surface 14, a first plate 12 having a surface associated with the press surface 14, a second plate 12 having a curved guide surface 13*a* which is provided in parallel with the press surface 14, and an arc guide body 15.

Figure 21:
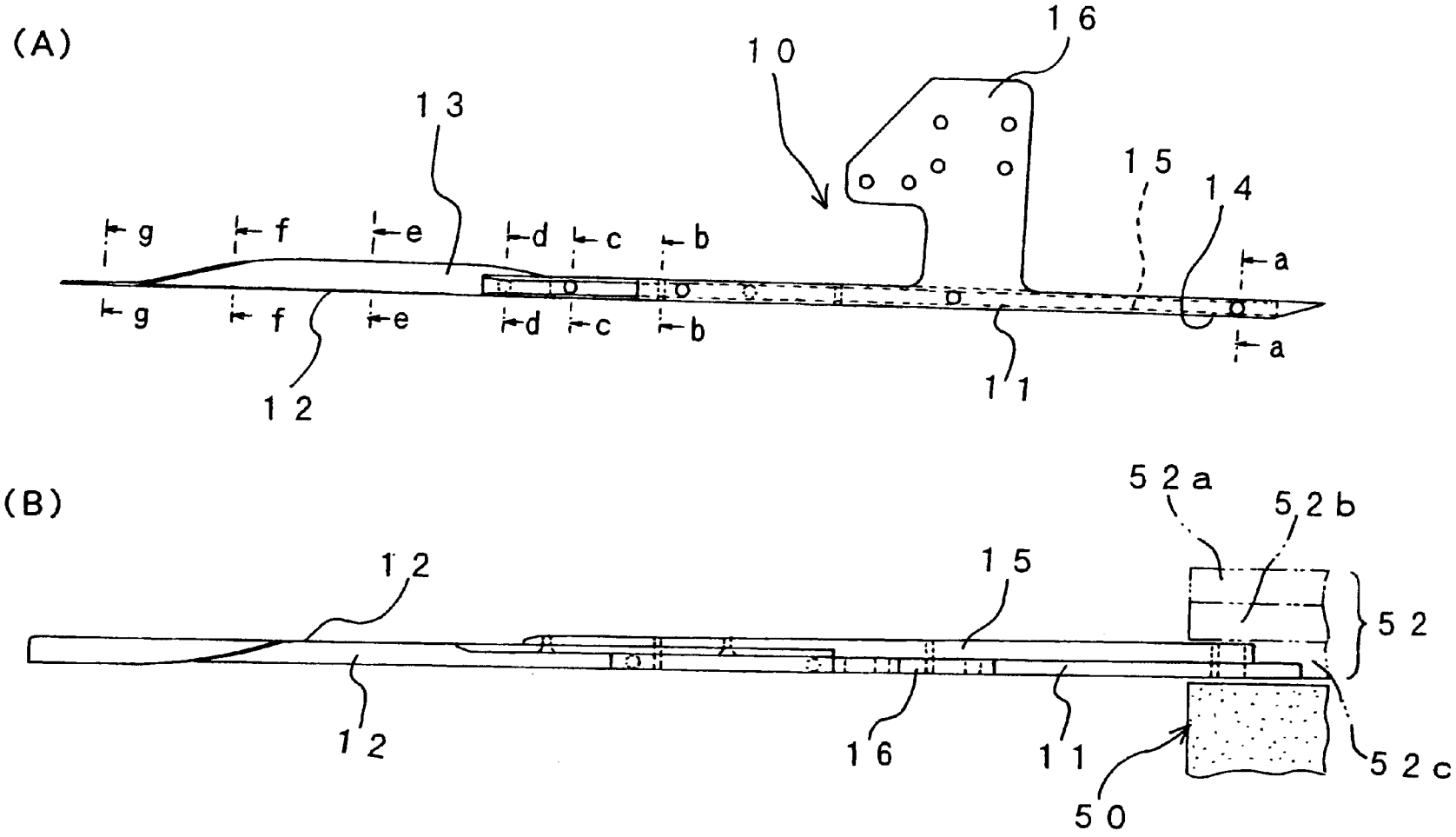
FIG. 21 shows a core device 10, wherein (A) is an enlarged view and (B) is a plan view.
Figure 24:
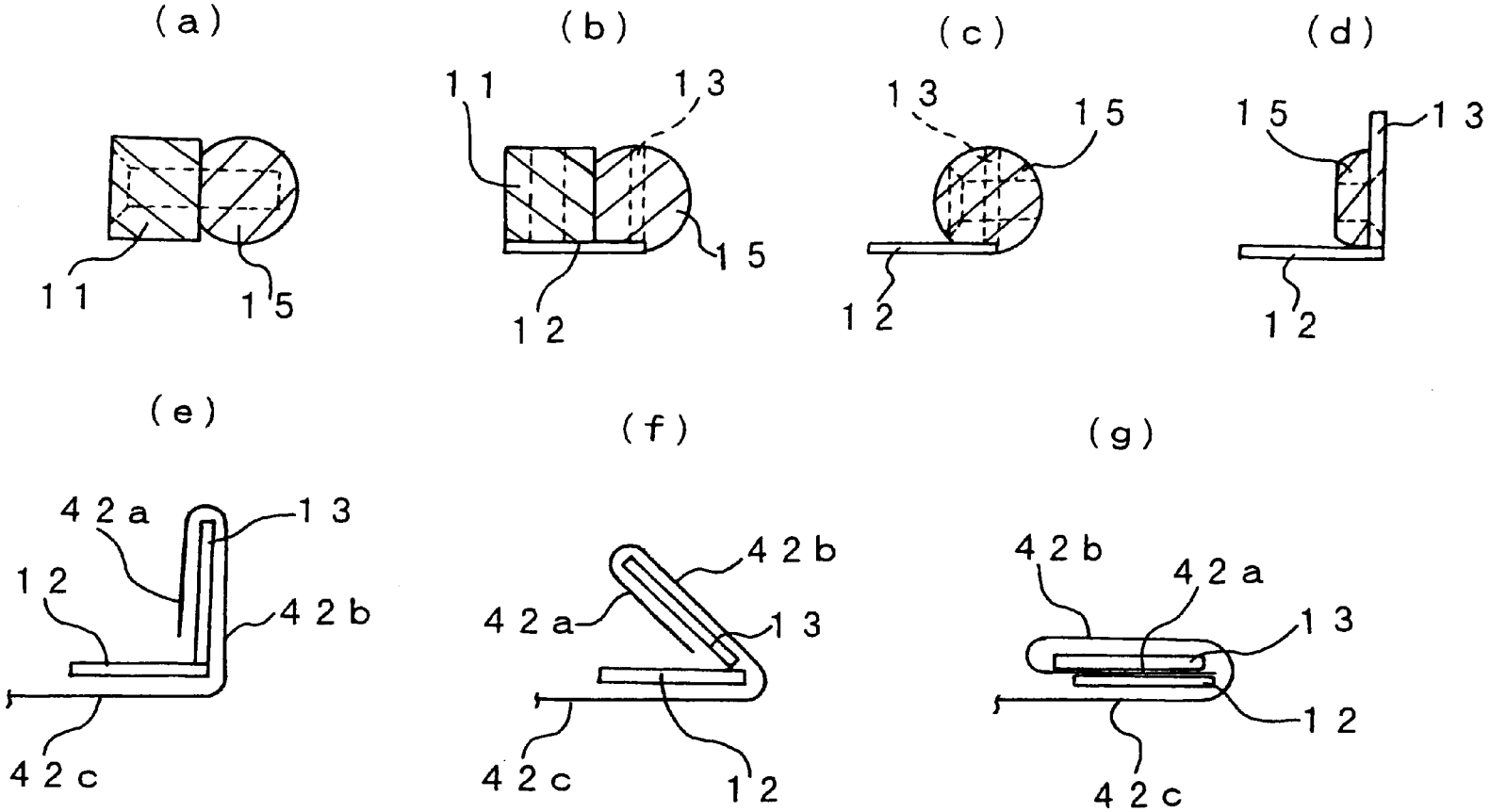
FIG. 24 is an enlarged sectional view of the core device respectively corresponding to a—g in FIG. 21(A)

As shown in FIG. 21 and FIG. 24(*a*) and (*b*), the core body 11 need have the press surface 14 for the inner portion 42*c*, a vertical surface and an upper surface. The first plate 12 and second plate 13 are preferably provided with spring means to be able to flexibly engage the fabric 40.

Figure 9:
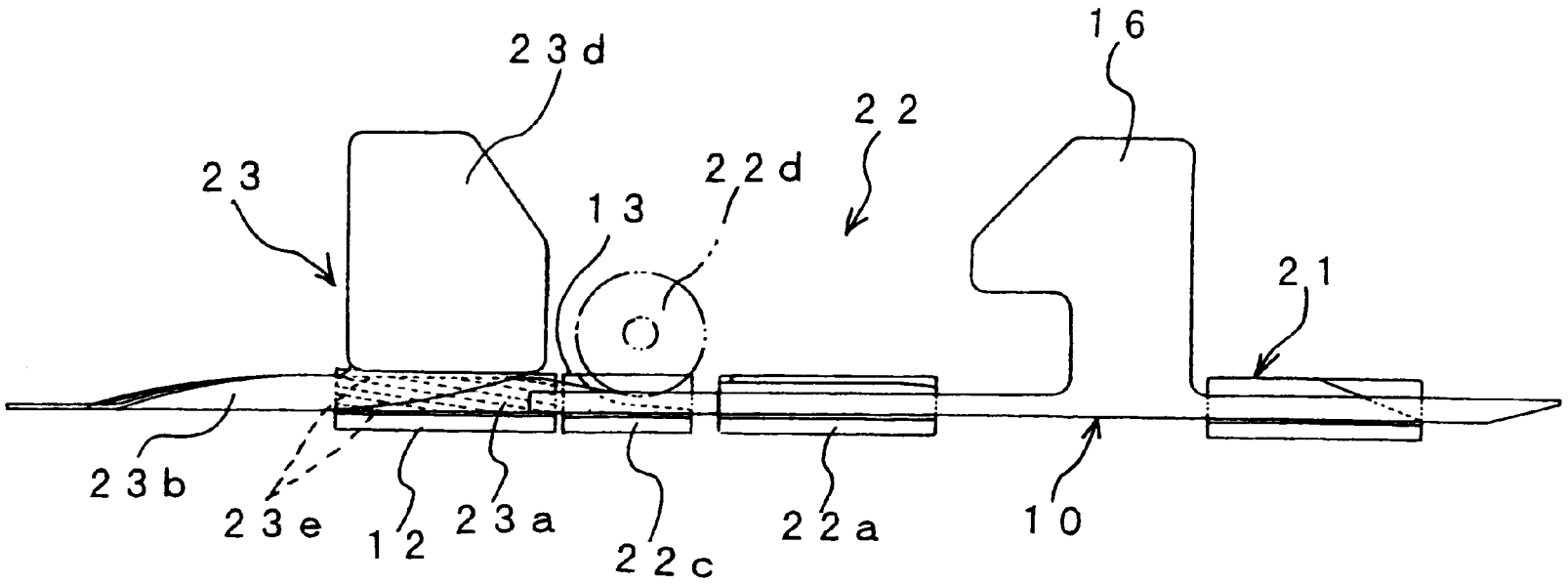
FIG. 9 is a schematic plan view showing the positional relationship between the members shown in FIG. 8 and the core device.

The roll core device 10 is supported on the support table 30 with a second holder apparatus 60 such that the device 10 can move up and down. An attachment plate 16 is utilized as shown in FIGS. 9 and 21. The attachment plate 16 is unitarily provided at the center of the core body 11. The support of the attachment plate 16 on the support table 30 through a guide device 17 and the second holder apparatus 60 concurrently provides the vertically movable support of the core body 11 and the first plate 12 and the second plate 13 relative to the support table 30, and assists the hem portion 42 having undulated surfaces to smoothly pass there.

Figure 22:
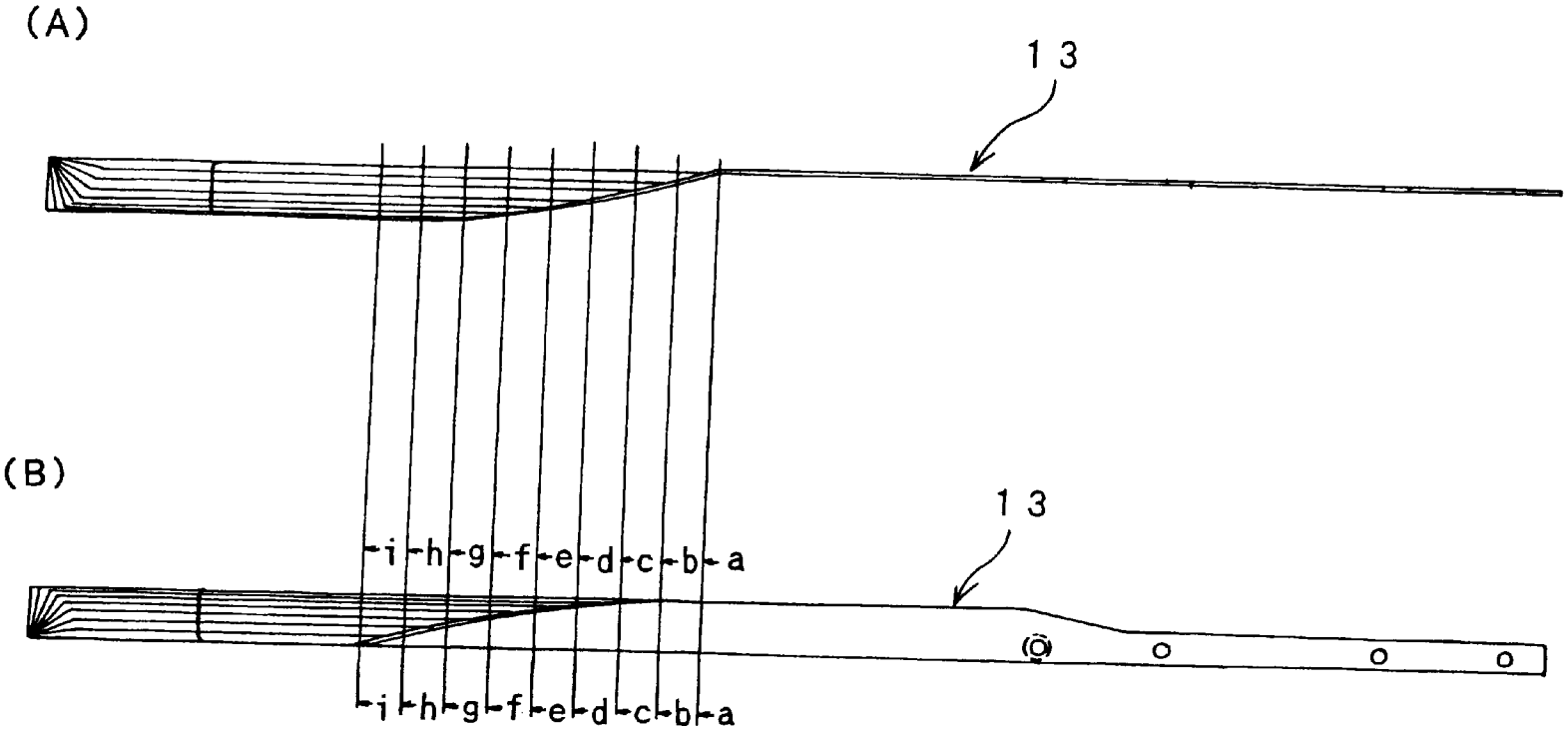
FIG. 22 shows a second plate 13, wherein (A) is an enlarged view and (B) is a front view.
Figure 23:
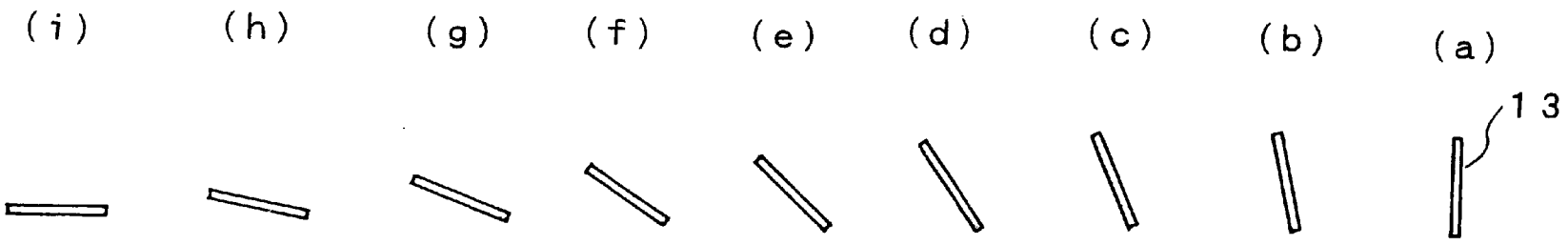
FIG. 23 is an enlarged sectional view respectively taken along lines a—a to i—i, showing the positional change of the second plate 13.

The lower surface of the first plate 12 provides the press surface 14, while the second plate 13 provides a surface which is configured as shown in FIGS. 22 and 23. The second plate 13 configured as such is capable of folding the outer portion 42*a* and middle portion 42*b* of the hem portion 42 onto the inner portion 42*c* as shown in FIG. 24(*e*)–(*g*). The inner surface of the second plate 13 provides a curved guide surface 13*a*.

The surface of the arc guide body 15 facing the oncoming hem portion 42 is configured as shown in FIG. 24 (*a*)–(*c*). The arc guide body 15 is nearly as long as the core body 11 as shown in FIG. 21. The arc guide body 15 is fixed to the core body 11 with bolts as shown in FIG. 21. The second plate 13 is attached to an end of the arc guide body 11. For this purpose, the arc guide body 15 has a split end to hold the second plate 13 as shown in FIG. 21(B).

The guide apparatus 20 is comprised of a number of members, including, as shown in FIGS. 6–20, a rounding plate 21 to round the outer portion 42*a* and inner portion 42*c* on the arc guide body 15, a rolling device 22 to fold the border of the rounded outer portion 42*a* and inner portion 42*c* onto the arc guide body 15, and a bending device 23 to fold the outer portion 42*a* along the second plate 13.

The rounding plate 21, rolling device 22 and bending device 23 are elastically attached to the support table 30 with spring means 32. The spring power of the spring means 32 can be adjusted bid an adjustment head 31.

FIG. 24 shows the roll core device 10 in detail. The members of the core device 10 change orientation in the order (a)–(g), which correspond (*a*)–(*g*) in FIG. 21.

FIG. 24(*a*) shows a unification of the core body 11 and the arc guide body 15 having a flat surface on the left for easy attachment to the core body 11. FIG. 24(*b*) shows addition of the first plate 12 and the second plate 13 attached to the arc guide body 15. FIG. 24(*c*)–(*e*) show the relative angular relationship between the first plate 12 and the second plate 13.

FIG. 24(*d*) shows detachment of the outer portion of the split end of the arc guide body 15. The middle portion 42*b* of the hem portion 42 can directly contact the outer surface of the second plate 13. As FIG. 24(*e*)–(*g*) show, the second plate 13 is turned 90 degrees (FIG. 23), while the first plate 12 keeps pressing the inner portion 42*c* of the hem portion 42.

Figure 4:
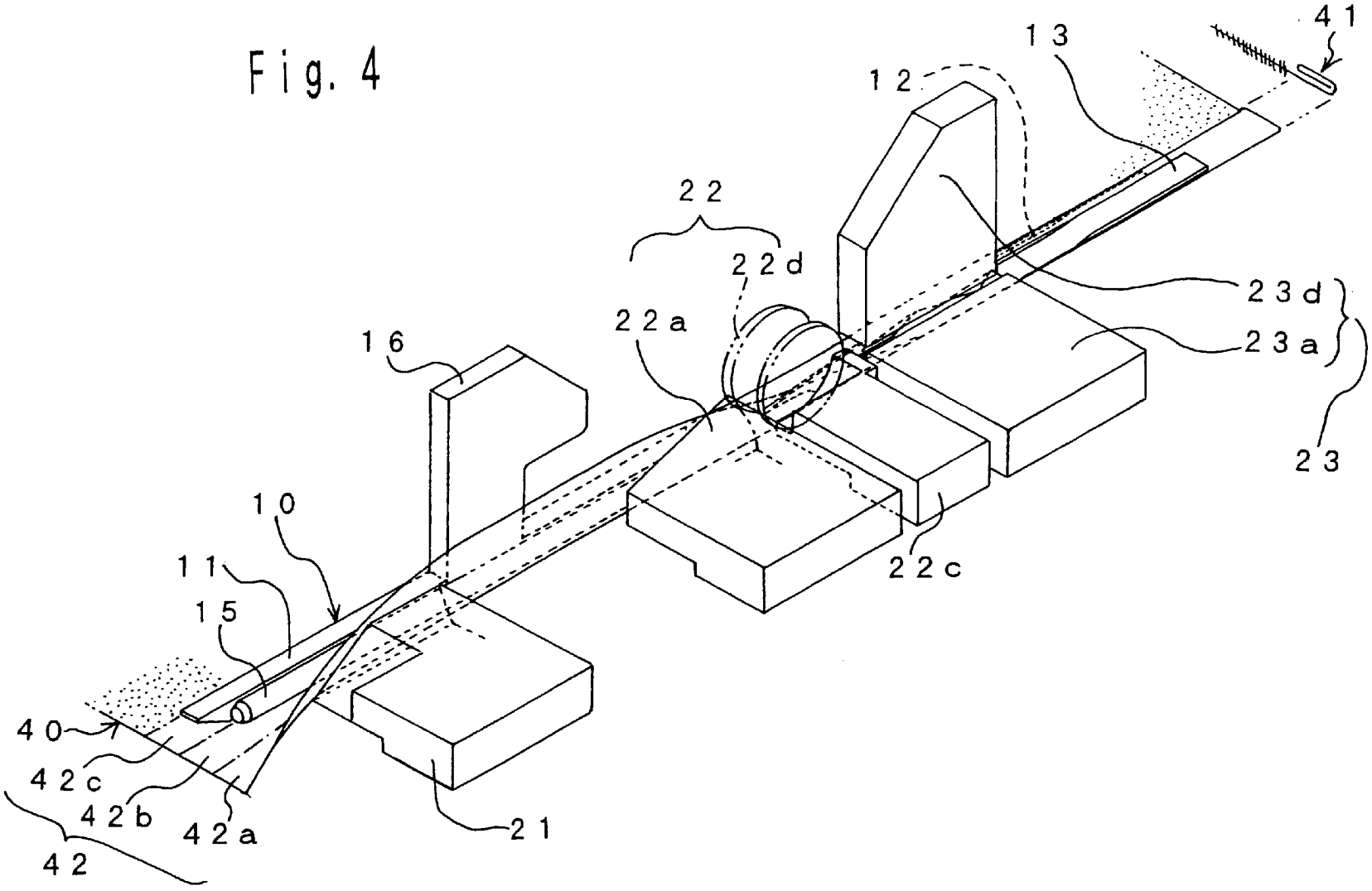
FIG. 4 is a schematic perspective view showing the change in orientation of the outer portion, middle portion and inner portion according to the present invention.
Figure 5:
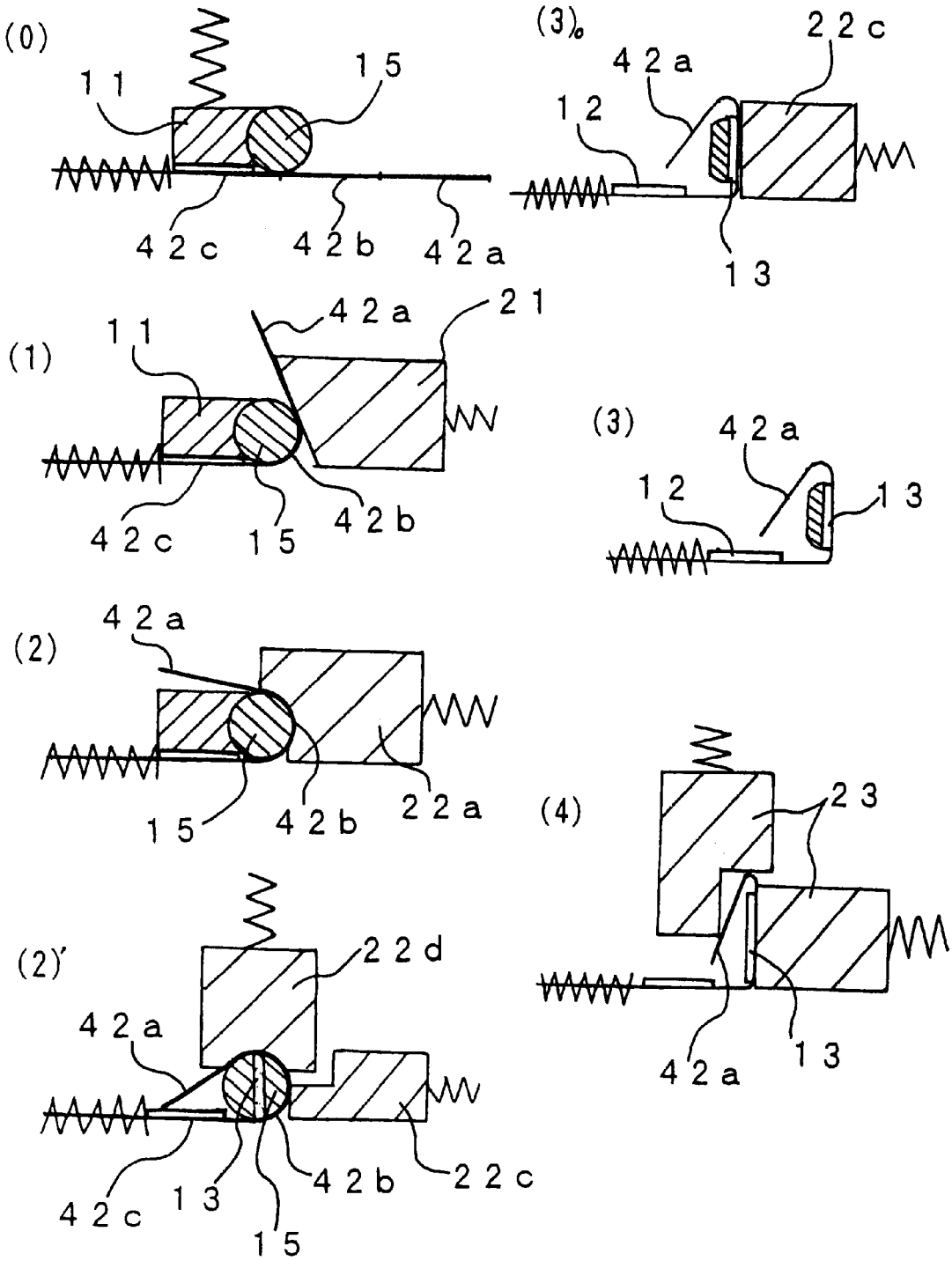
FIG. 5 shows the positional relationship between the various members of the rolled hem provider of the present invention and the hem portion in accordance with steps 0–4 of FIG. 4.
Figure 7:
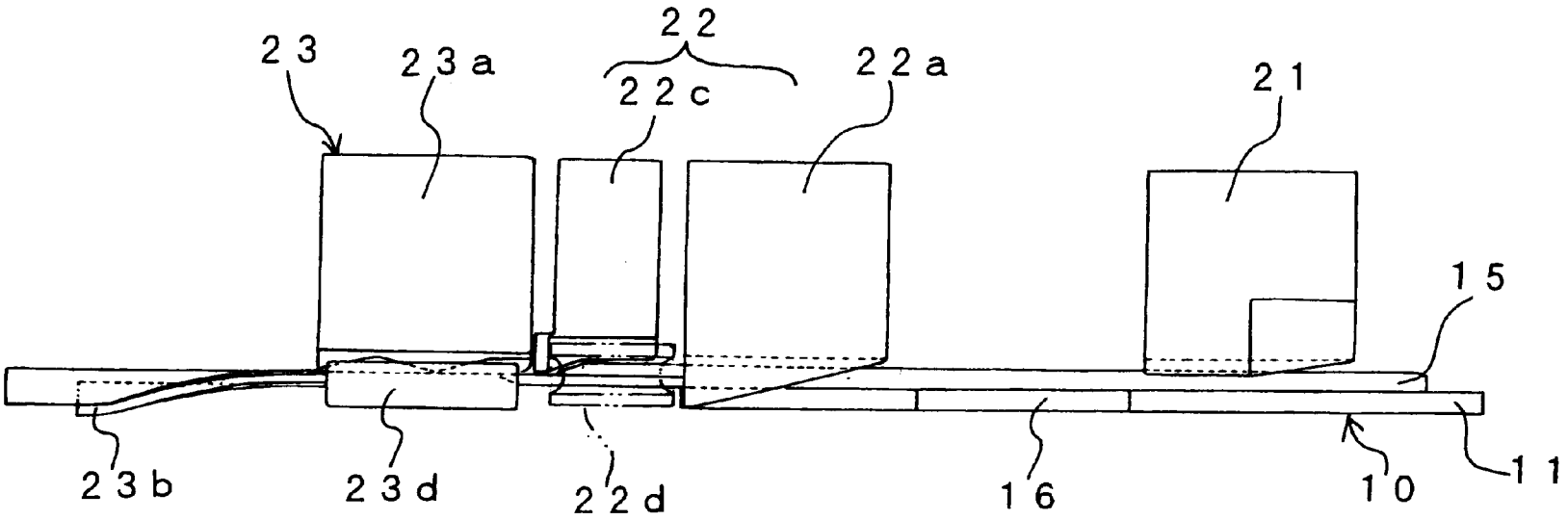
FIG. 7 is a schematic front view showing the positional relationship between some members shown in FIG. 6 and the core device.
Figure 8:
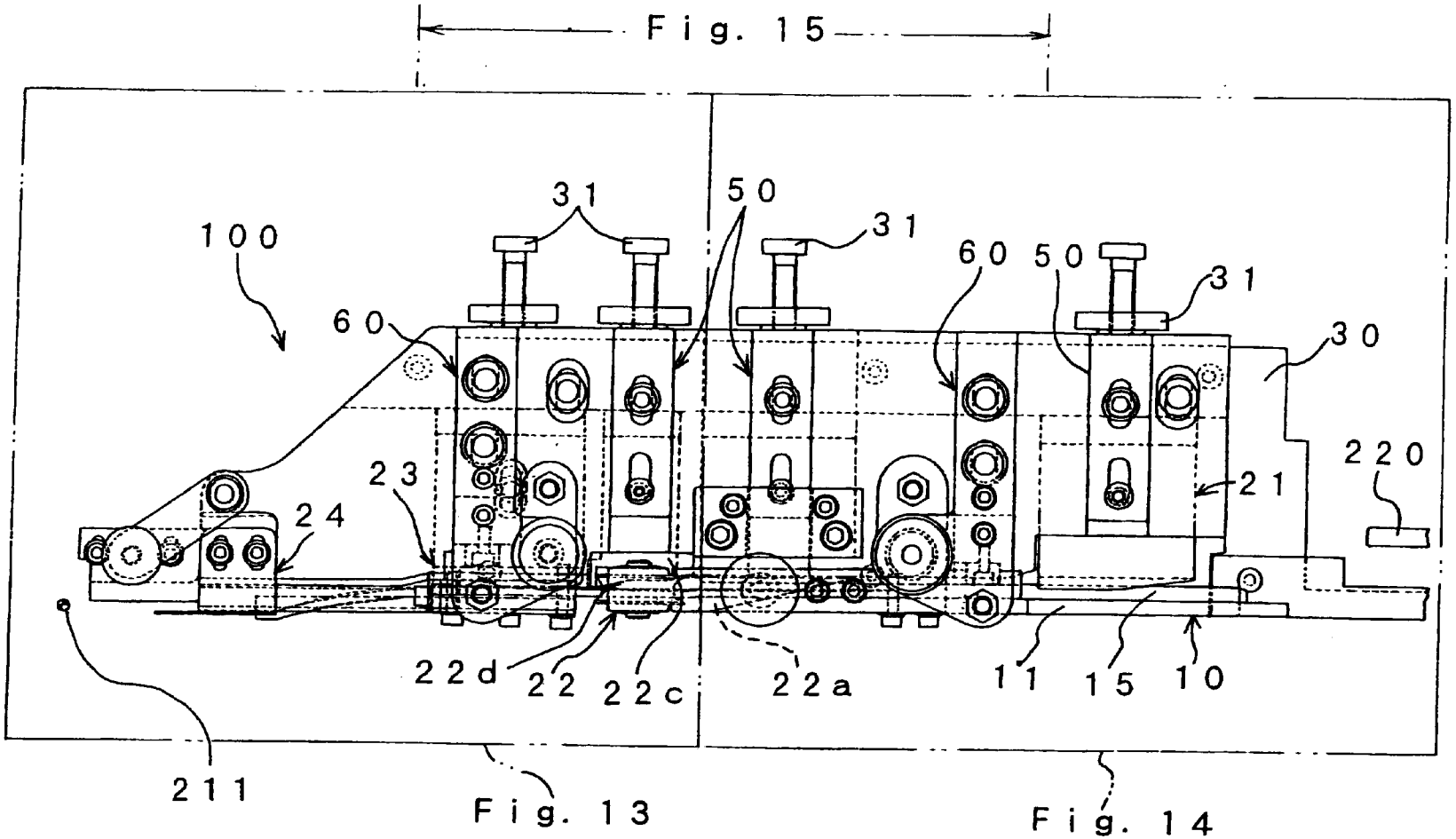
FIG. 8 is a plan view thereof.

As FIGS. 4, 7 and 9 show, around the core device 10 is provided the guide apparatus 20 comprising the rounding plate 21, rolling device 22, bending device 23 and a rolled portion holder 24. The rounding plate 21 of the guide apparatus 20 lifts the outer portion 42*a* and presses the middle portion 42*b* onto the outer surface of the arc guide body 15, as shown in FIG. 5 (1).

The rounding plate 21 has a pick-up surface at the proximal end to pick up the outer portion 42*a* of the hem portion 42 as shown in FIGS. 4, 7 and 9. The rounding plate 21 is also provided with a slope facing the outer surface of the arc guide body 15. The rounding plate 21 is connected with a base plate 21*a* fixed on the support table 30 via spring means 32, which is held movably relative to the core device 10 by means of a first holder apparatus 50. Thus, the rounding plate 21 can pick up the outer portion 42*a*. The slope is biased against arc guide body 15 of the core device 10 with the spring means 32 so that an undulated hem portion 42 can be securely engaged. The spring power can be adjusted by the adjustment head 31.

Figure 16:
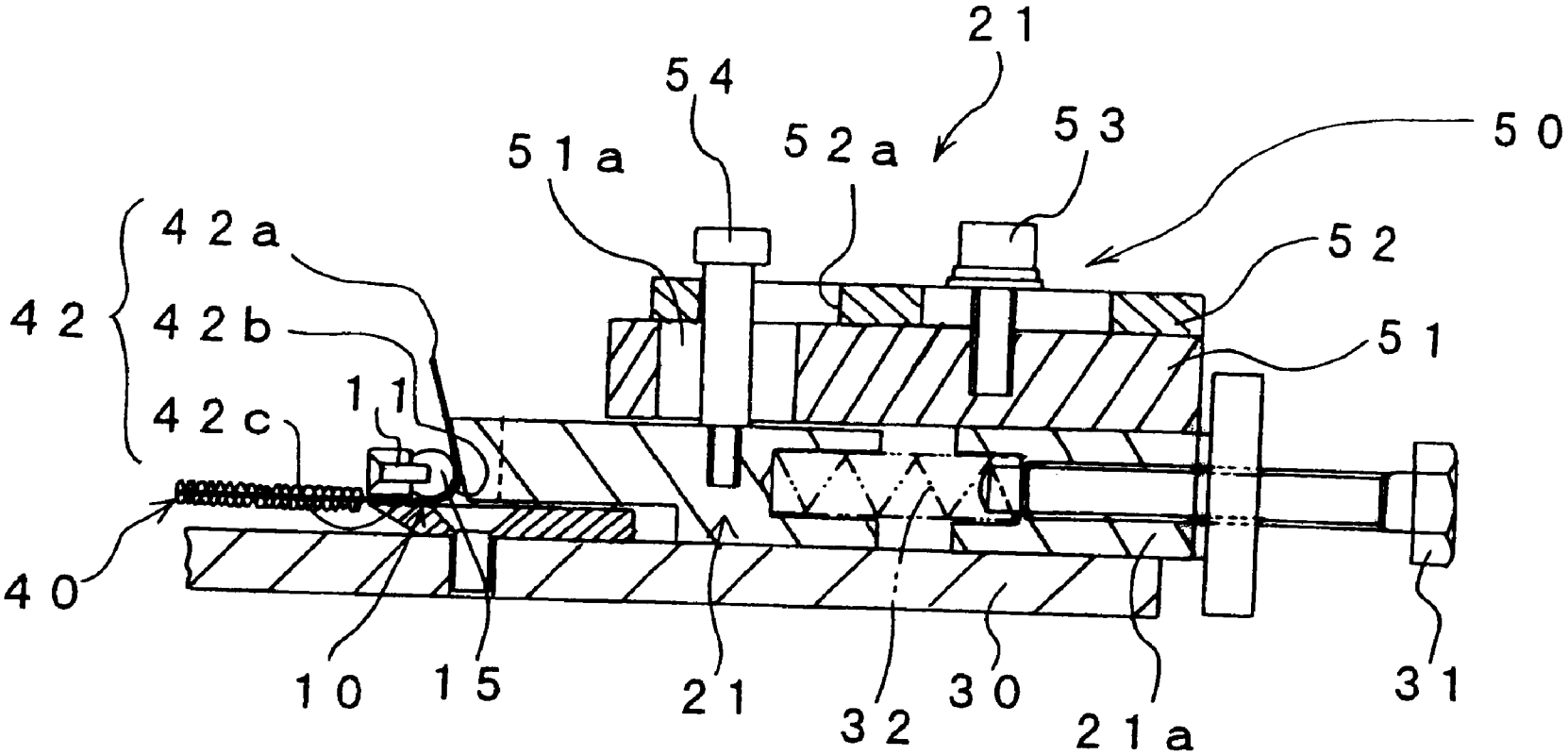
FIG. 16 is an enlarged sectional view taken along line 7—7 of FIG. 6.

As shown in FIG. 16, the first holder apparatus 50 which movably holds the rounding plate 21 on the support table 30 is provided with a holder table 51 to fix the base plate 21*a* on the support table 30, an adjuster board 52 to be fixed with fixing bolts 53 on the holder table 51, and an adjustment pin 54 installed on the rounding plate 21. Thus, the first holder apparatus 50 movably holds the rounding plate 21 against the core device 10 and protects the core device 10 and the rounding plate 21 by preventing the slope of the rounding plate from colliding with, the core device 10. The adjustment pin 54 is positioned in an adjustment hole 52*a* of the adjuster board 52 through an opening 51*a* of the holder table 51. The rounding plate 21 is at the foremost when the adjustment pin 54 is in contact with the front face of the adjustment hole 52*a*. The foremost position can be adjusted by adjusting the fixing position of the adjuster board 52 on the holder table 51.

As shown in FIG. 16, the rounding plate 21 picks up the outer portion 42*a* and middle portion 42*b*, and presses the middle portion 42*b* against the arc guide body 15. The inner portion 42*c* is pressed with the press surface 14 of the core body 11 of the core device 10.

Figure 17:
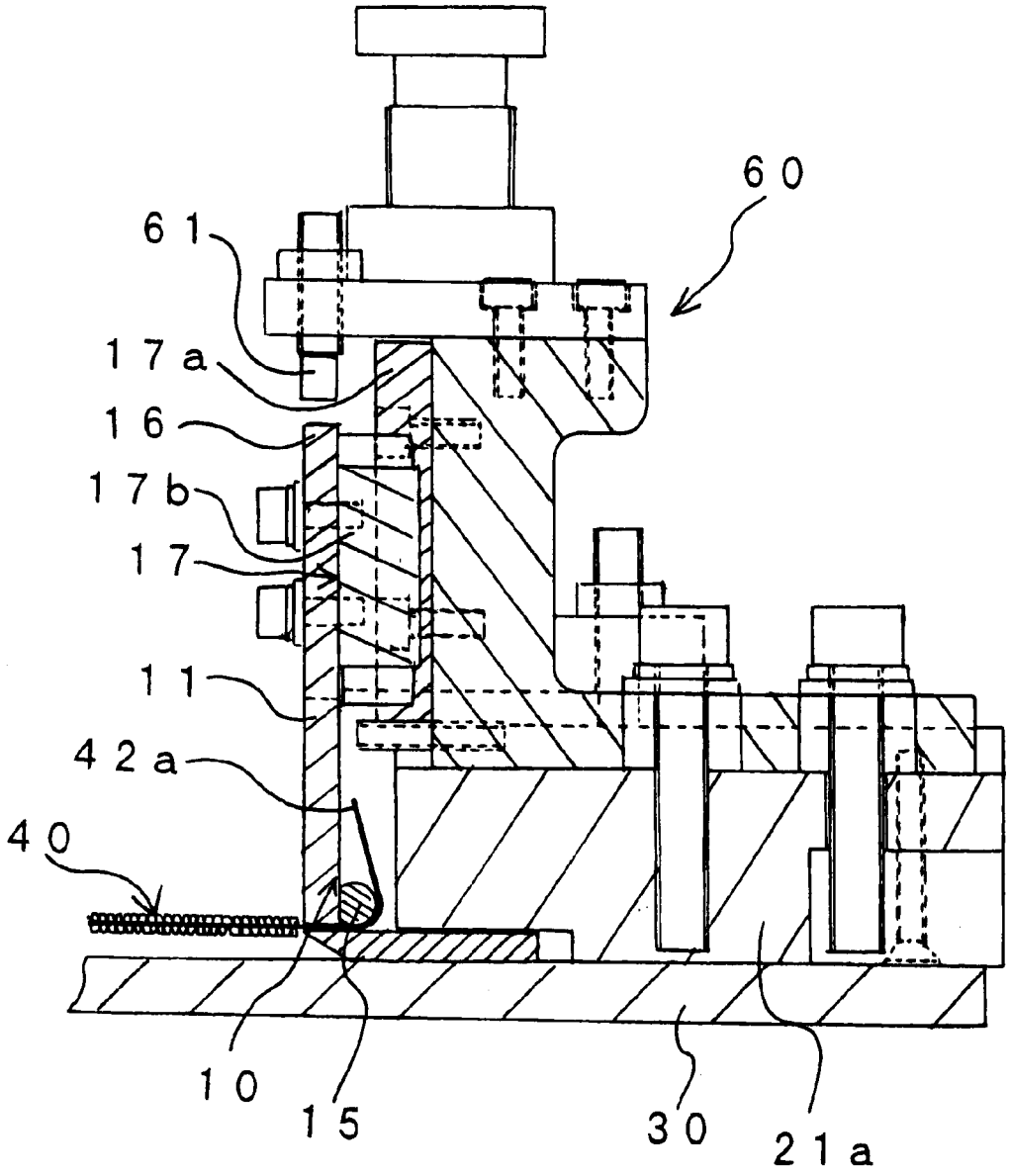
FIG. 17 is an enlarged sectional view taken along line 8—8 of FIG. 6.

FIG. 17 shows how the core device 10 positioned between the rounding plate 21 and a rolling device 22 is held relative to the support table 30. The core device 10 supports the core body 11, the first plate 12 and the second plate 13 by connecting the attachment plate 16 to the second holder apparatus 60 via a guide device 17 so as to securely receive a hem portion 42 which may be undulated.

As shown in FIG. 17, the guide device 17 which connects the core device 10 to the second holder apparatus 60 is comprised of an up-down rail 17*a* to be mounted on the second holder apparatus 60 and a case 17*b* to be mounted on the attachment plate 16 movably relative to the up-down rail 17*a*. Thus the core device 10 can move up and down relative to the second holder Apparatus 60. A thick/undulated hem portion 42 can be appropriately guided upward by the guide device 17 and a thin hem portion 42 can be appropriately guided downward. An elastic stopper 61 elastically controls the upper limit of the attachment plate 16 of the core device 10.

Figure 18:
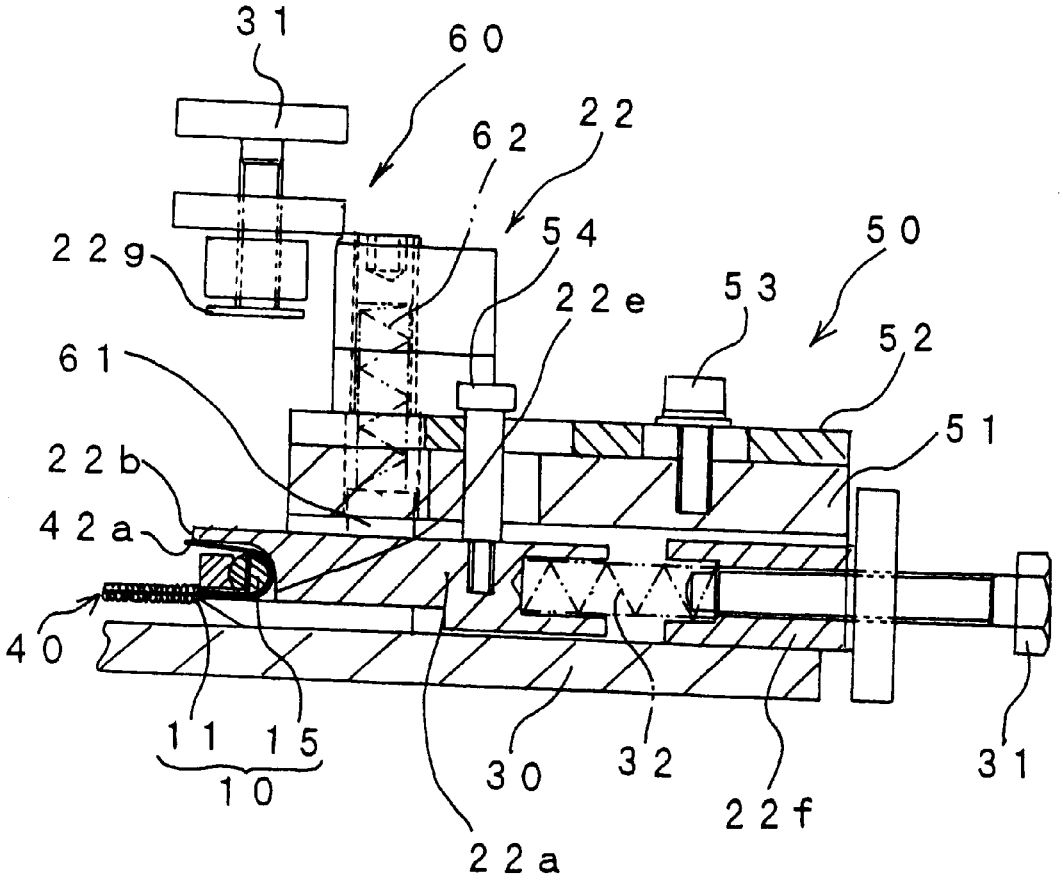
FIG. 18 is an enlarged sectional view taken along line 9—9 of FIG. 6.
Figure 19:
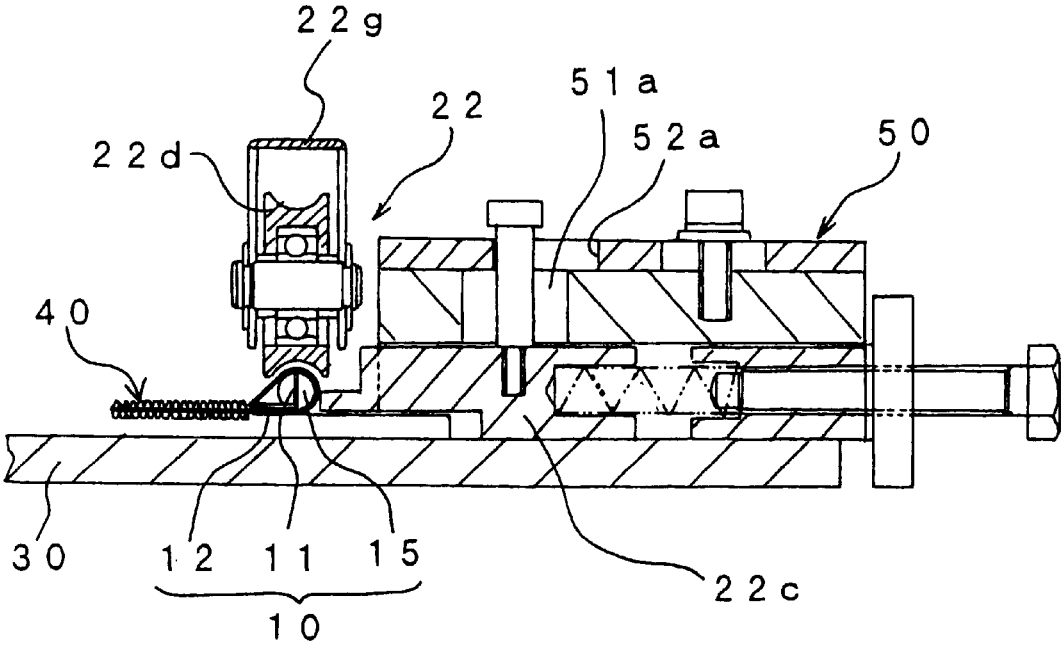
FIG. 19 is; an enlarged sectional view taken along line 10—10 of FIG. 6.

As shown in FIGS. 18 and 19, the semi-rounded hem portion 42 is further rounded by the rolling device 22. The rolling device 22 includes a first press piece 22*a* and a second press piece 22*c* shown in FIG. 18, and a press roll 22*d* shown in FIG. 19. As shown in FIGS. 7 and 18, the first press piece 22*a* has a protrusion 22*b*. The underside of the protrusion 22*b* is a press surface 22*e* whose configuration matches the outer shape of the arc guide boded 15 as FIG. 18 shows.

The protrusion of the first press piece 22*a* can escape from the core device 10 when the hem portion 42 is thick. As shown in FIG. 18, the elastic stopper 61 is in contact with the upper side of the protrusion 22*b*. The elastic stopper 61 is elastically supported by a stop member 62. The adjustment head 31 shown in FIG. 18 controls the spring power of the spring board 22*g* shown in FIGS. 14 and 19 which supports the press roll 22*d* shown in FIG. 19.

The rolling device 22 is connected with the base 22*f* and movably supported on the core device 10 with its front end controlled by the adjustment pin 54.

As shown in FIGS. 16 and 18, the outer portion 42*a* and middle portion 42*b* are further rounded by the first press piece 22*a* on the arc guide body 15. Next, the outer portion 42*a* will be pressed onto the middle portion 42*b*. The first press piece 22*a* advances or retreats depending on the thickness of the hem portion 42 as the rounding plate 21.

As FIGS. 7 and 19 show, the press roll 22*d* and the second press piece 22*c* are arranged around the arc guide body 15 as shown in FIG. 19 to further roll the outer portion 42*a* of the hem portion 42 on the arc guide body 15 of the core device 10. As shown in FIG. 19, the second press piece 22*c* of the rolling device 22 is movably supported by a first holder apparatus 50 as shown in FIG. 16 and presses the hem portion 42 onto the arc guide body 15.

Figure 6:
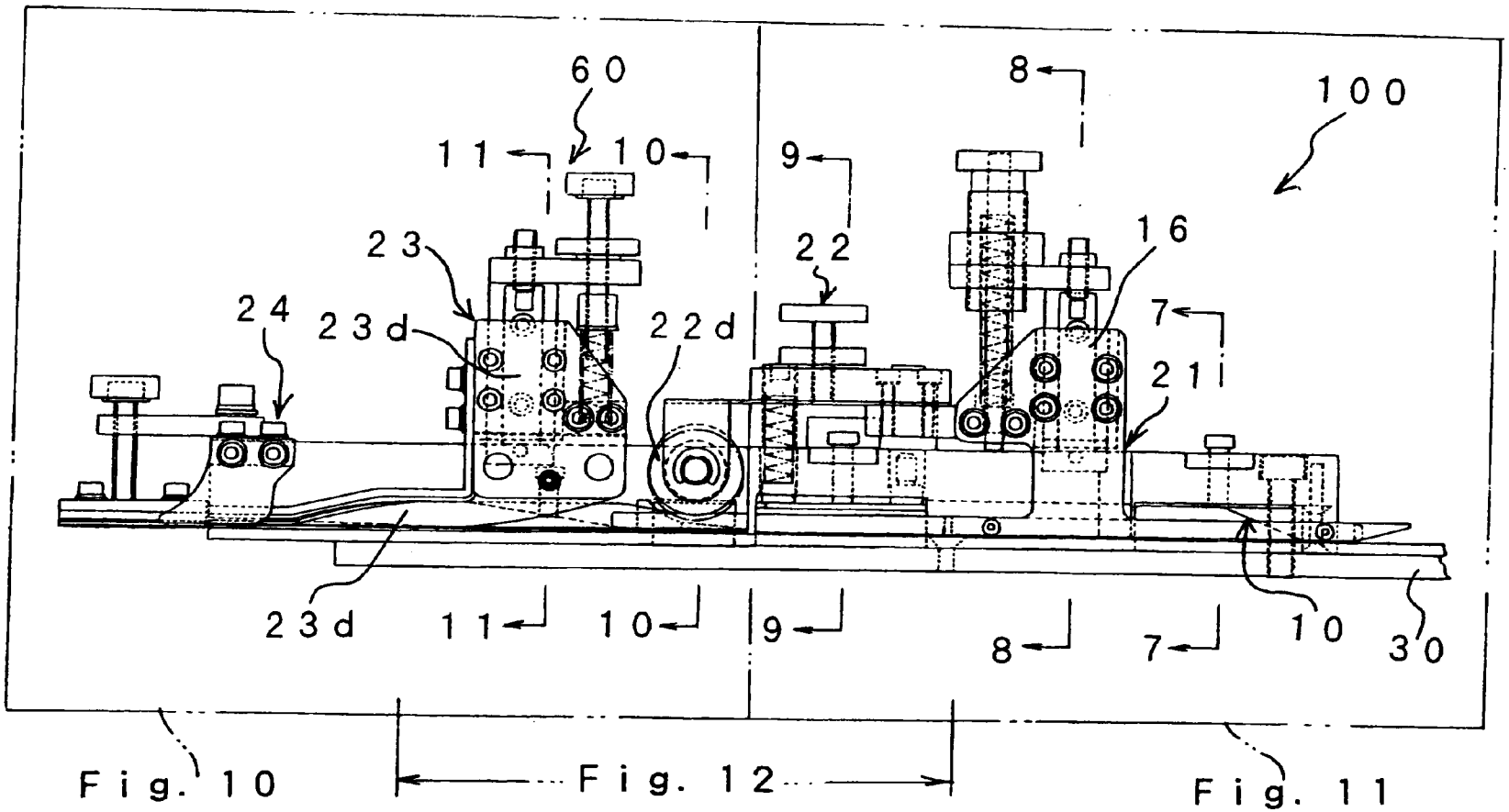
FIG. 6 is a front view showing the rolled hem provider of the present invention.
Figure 12:
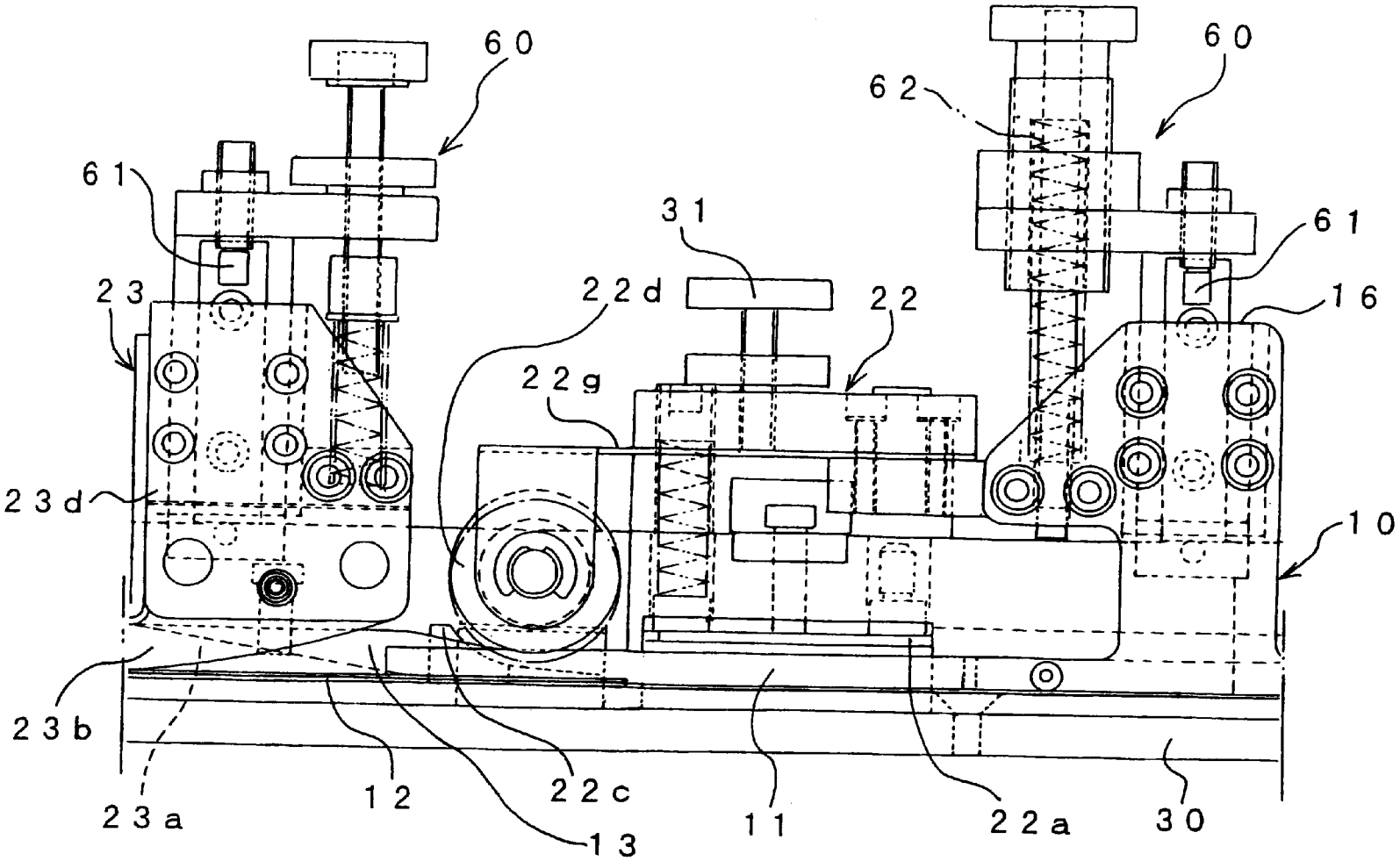
FIG. 12 is an enlarged view of the portion indicated by "FIG. 12" in FIG. 6.
Figure 13:
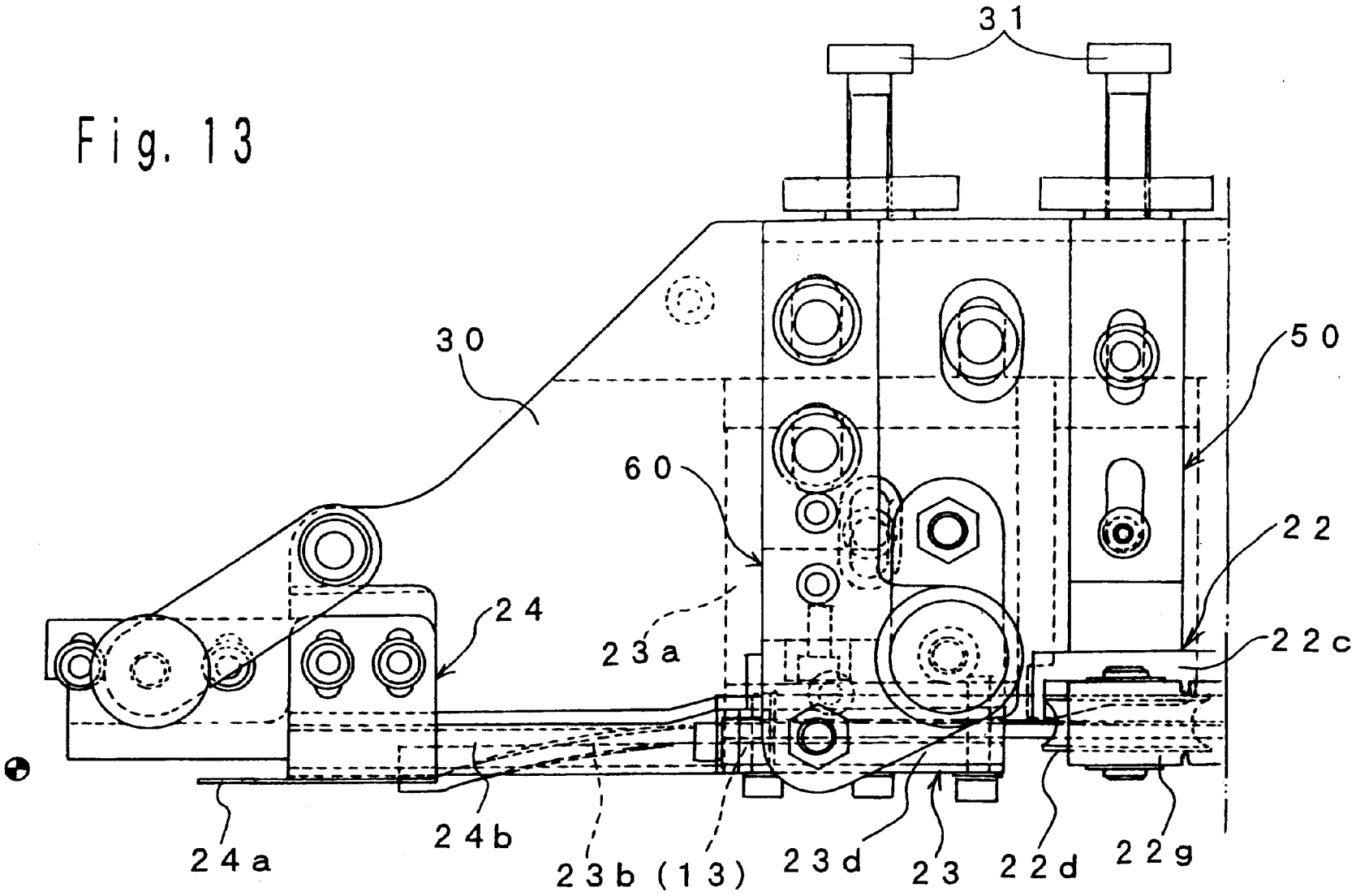
FIG. 13 is; an enlarged view of the portion indicated by "FIG. 13" in FIG. 8.
Figure 14:
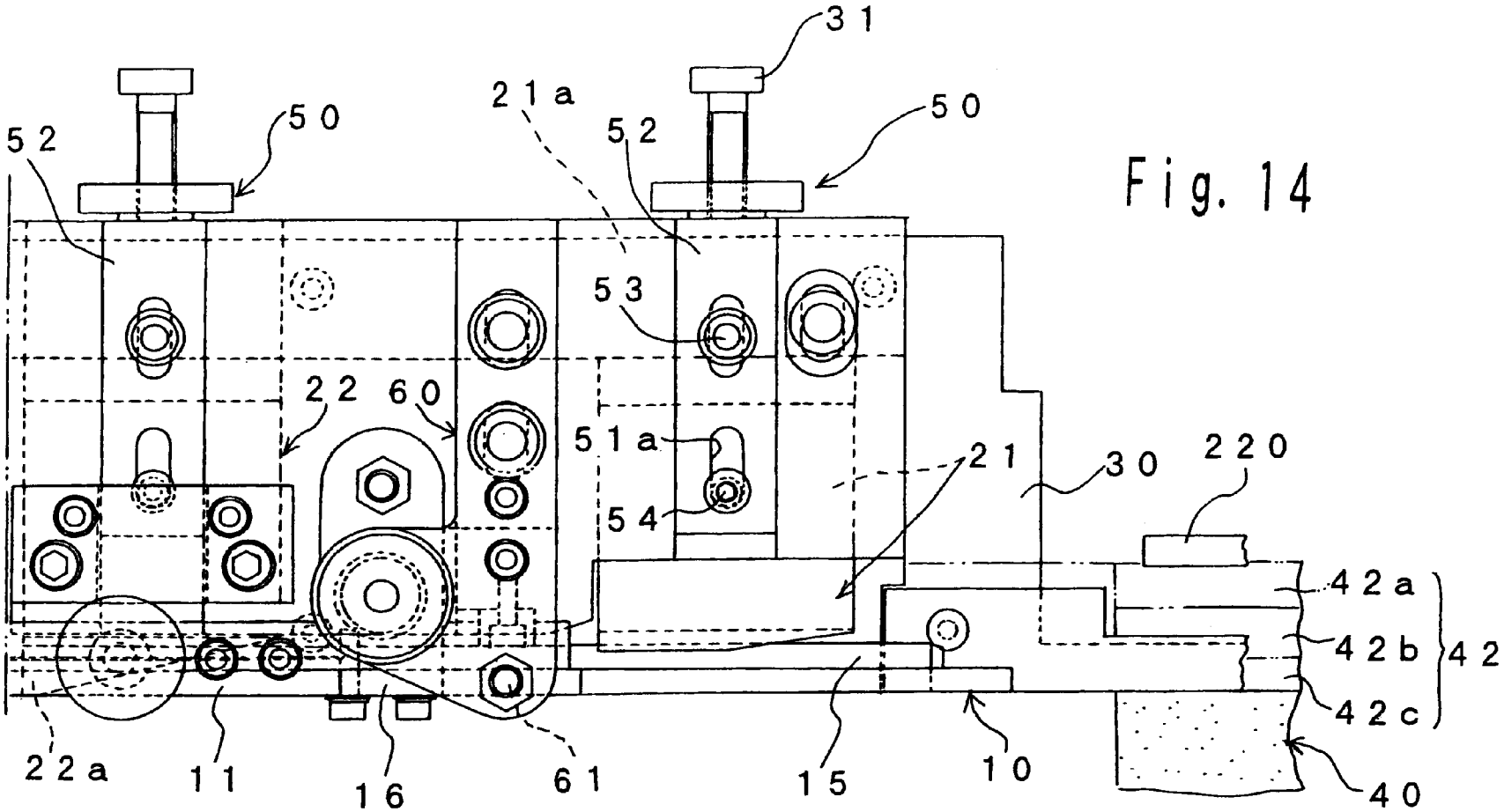
FIG. 14 is an enlarged view of the portion indicated by "FIG. 14" in FIG. 8.
Figure 15:
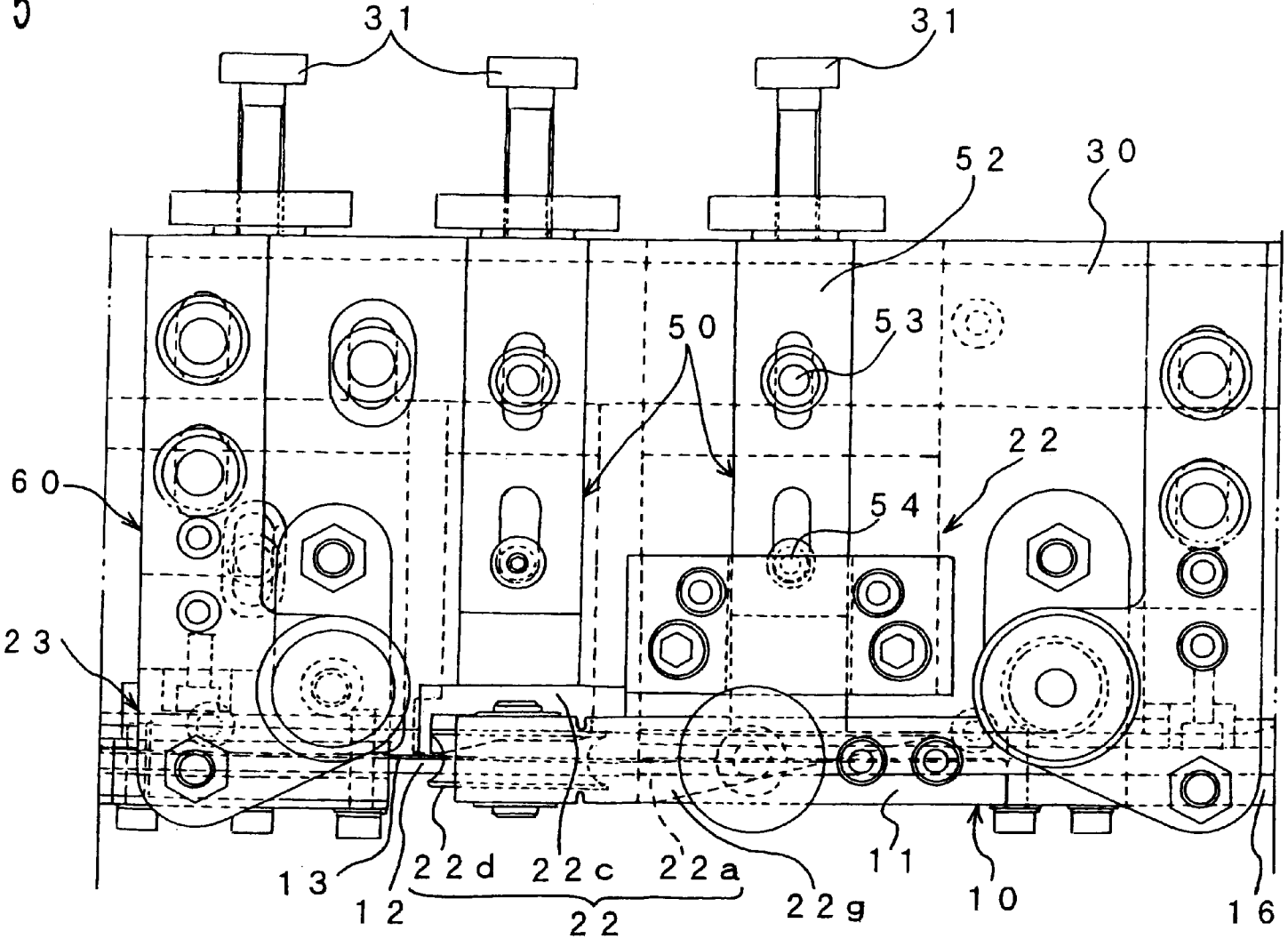
FIG. 15 is an enlarged view of the portion indicated by "FIG. 15" in FIG. 8.

As shown in FIG. 6, the press roll 22*d* of the rolling device 22 presses the hem portion 42 from above the core device 10. As shown in FIG. 19, the core body 11 of the core device 10 is replaced by the arc guide body 15, the first plate 12 and the second plate 13. The press roll 22*d* is supported by the spring board 22*g* as shown in FIGS. 12 and 19 so to be located above the arc guide body 15. The press surface of the press roll 22*d* is configured so as to match the outer surface of the arc guide body 15. When the press roll 22*d* is pressed against the arc guide body, 151, the border between the outer portion 42*a* and the middle portion 42*b* on the arc guide body 15 is pressed. The outer portion 42*a* and middle portion 42*b* are rounded on the arc guide body 15 as shown in FIG. 19. The press roll 22*d* is positioned as shown in FIG. 6.

As shown in FIG. 19, the outer portion 42*a* and middle portion 42*b* are rounded on the arc guide body 15. The outer portion 42*a* is then folded onto the middle portion 42*b*. The bending device 23 located next to the rolling device 22 as shown in FIGS. 4, 7 and 9 will do this process.

Figure 20:
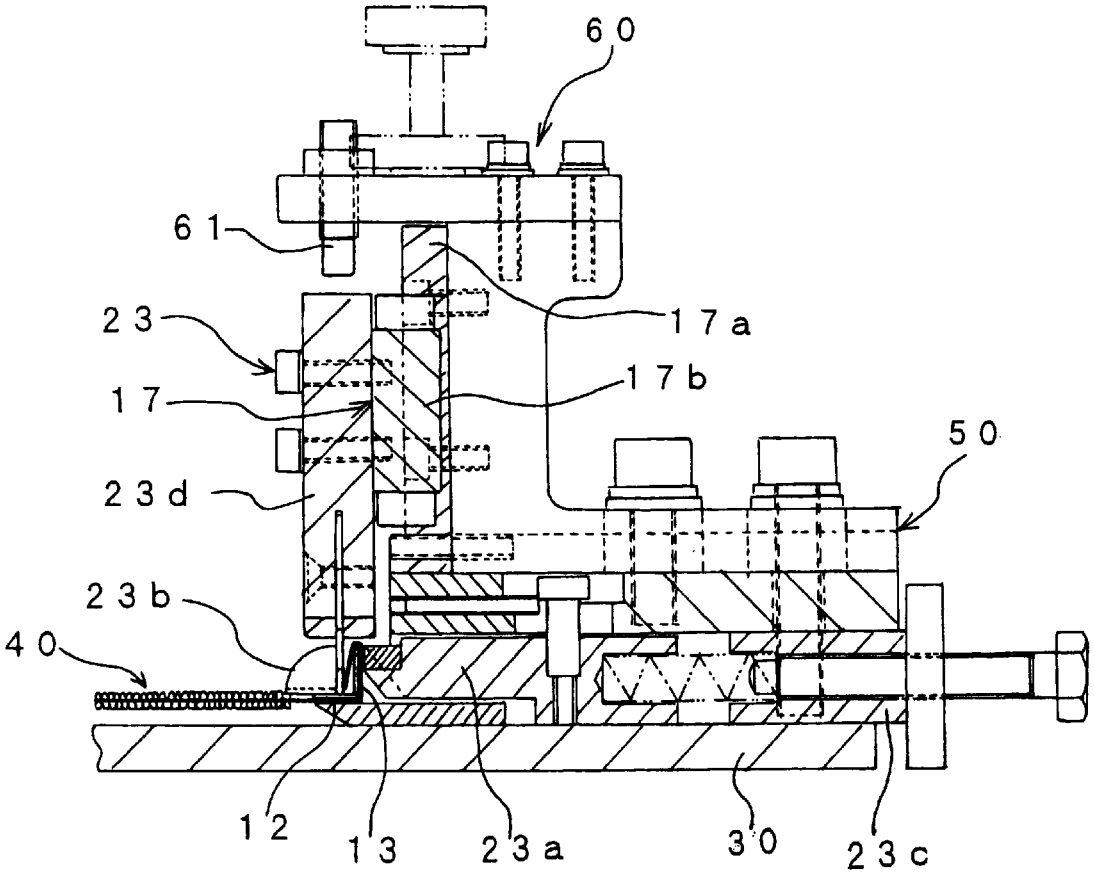
FIG. 20 is, an enlarged sectional view taken along line 11—11 of FIG. 6.

As shown in FIG. 20, the bending device 23 is provided at the location of the first plate 12 and the second plate 13, where the core body 11 and the arc guide body 15 no longer exist. The bending device 23 has a press piece 23*a* and a guide piece 23*b*.

The press piece 23*a* is supported on the support table 30. The front surface of the press piece 23*a* is provided with a plurality of guide streaks 23*e*. As shown in FIG. 19, the guide streaks 23*e* incline toward the distal end to swiftly pull up the middle portion 42*b*. The middle portion 42*b* is guided upward behind the second plate 13.

As shown in FIGS. 6 and 9, the guide piece 23*b* is integrally attached to the underside of the guide piece 23*d*. As shown in FIG. 20, the guide piece 23*d* supports the second holder apparatus 60 utilizing a guide device 17 such as used on the core device 10.

Figure 10:
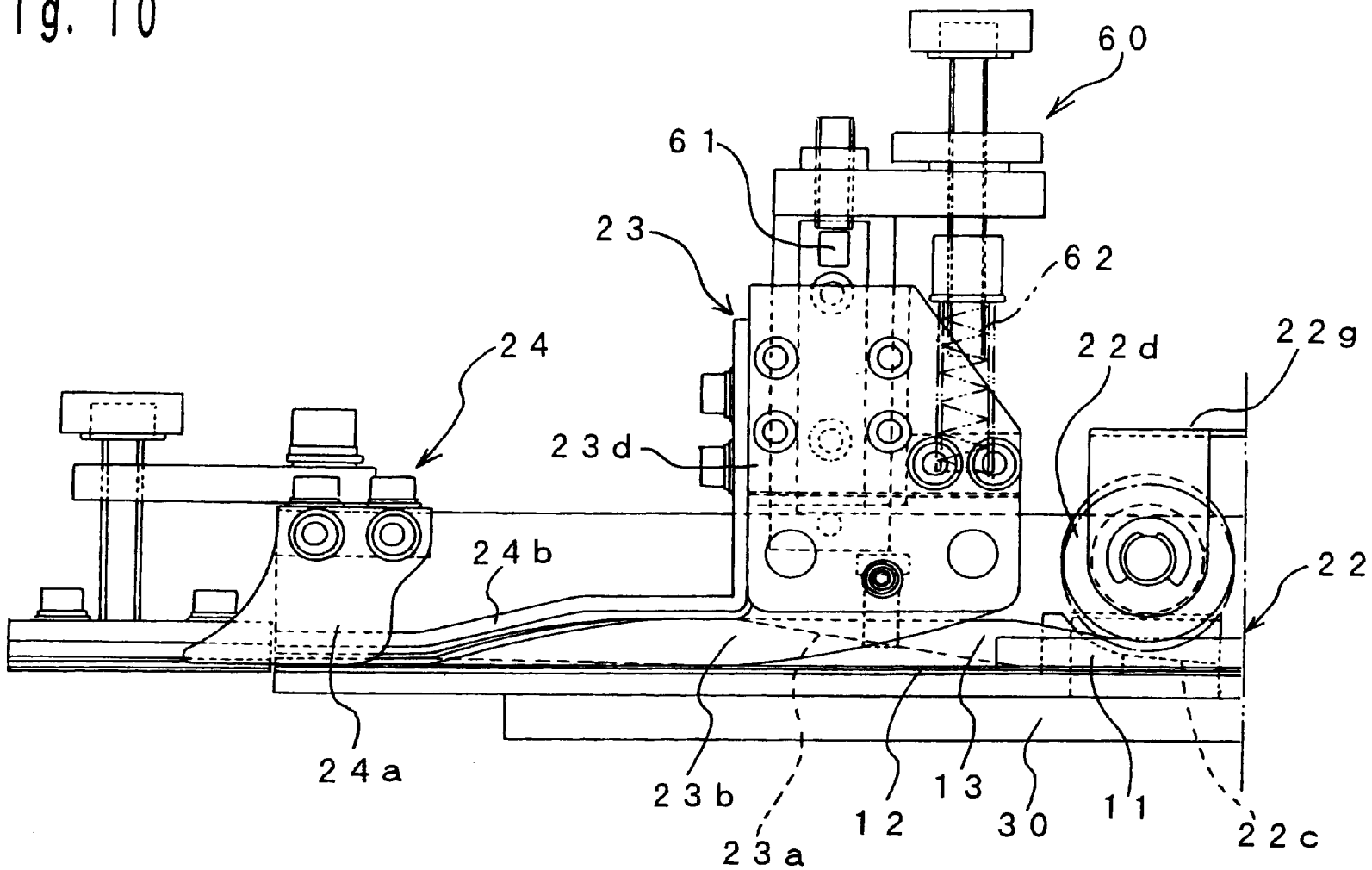
FIG. 10 is an enlarged view of the portion indicated by "FIG. 10" in FIG. 6.
Figure 11:
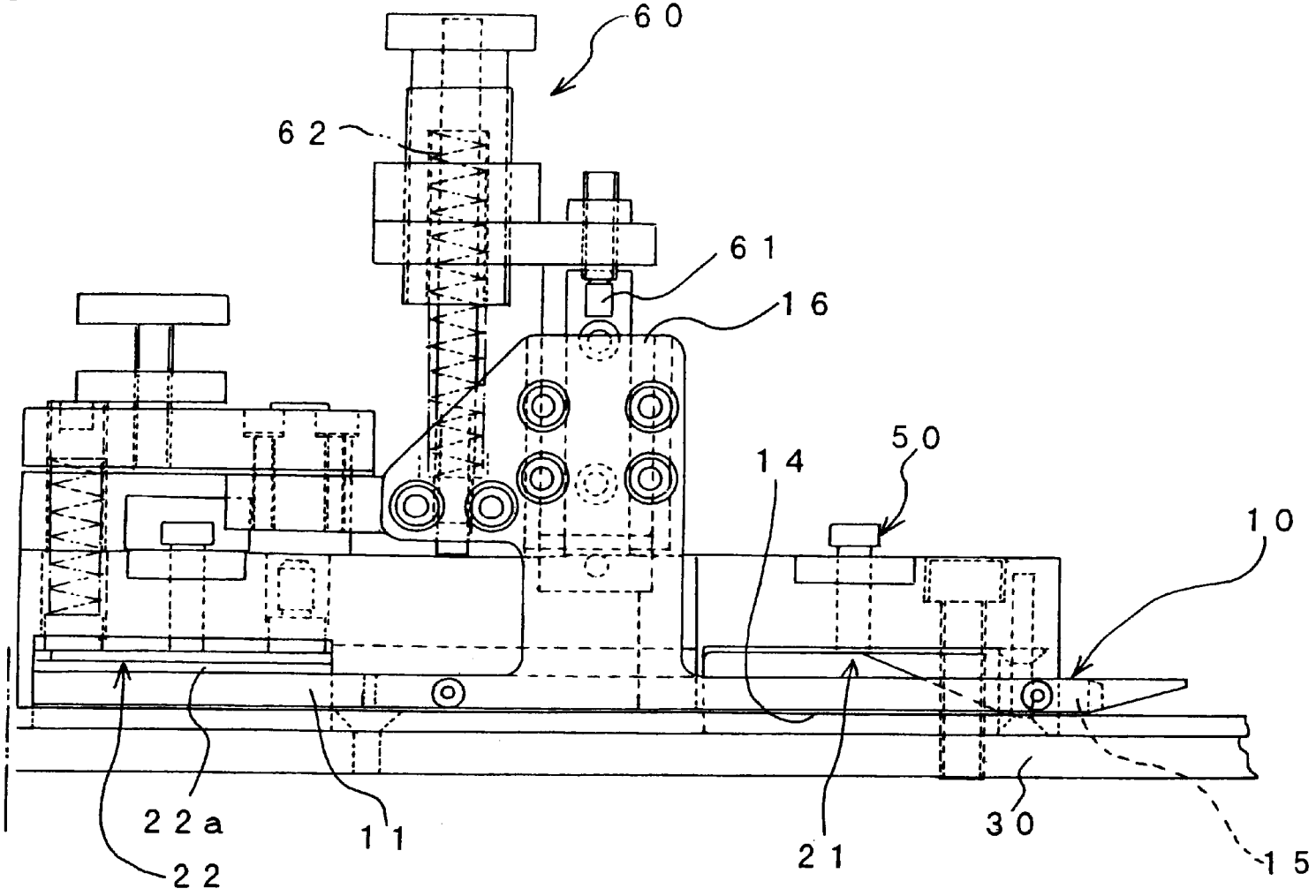
FIG. 11 is an enlarged view of the portion indicated by "FIG. 11" in FIG. 6.

The guide piece 23*b* of the bending device 23 falls in parallel with the second plate 13. As shown in FIGS. 10 and 20, the distal end of the guide piece 23*b* is provided with a slanting guide surface which slants along the curved guide surface 13*a* of the second plate 13.

The outer portion 42*a* of the hem portion 42 is guided through the bending device 23 such that the outer portion 42*a* is wound 90 degrees between the guide piece 23*b* of the bending device 23 and the curved guide surface 13*a* of the second plate 13. FIG. 25(A) shows the rolled state of the outer portion 42*a*, middle portion 42*b* and inner portion 42*c*.

Figure 25:
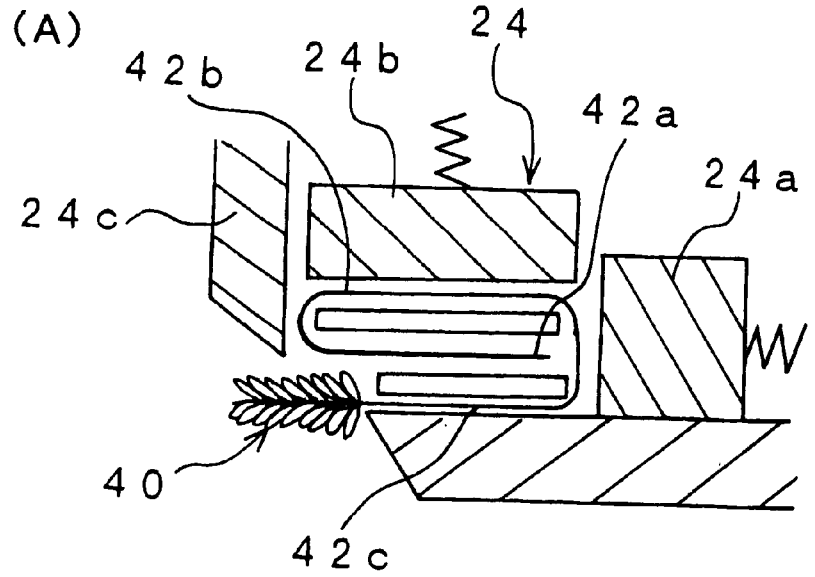
FIG. 25 is a schematic sectional view showing the holding means of the rolled hem provider of the present invention, wherein (A) is an enlarged view of the proximal end and (B) is an enlarge view of the distal end.
Figure 25:
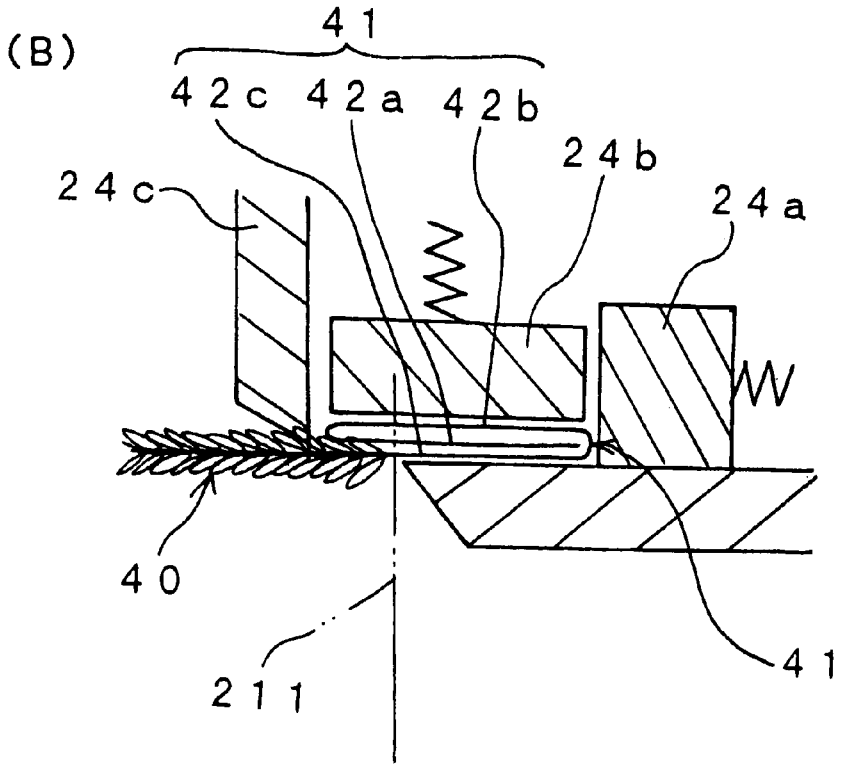

The rolled hem portion 42 is sent toward the stitching device 210 while keeping the rolled configuration by means of the rolled portion holder 24 placed at the advancing end of the core device 10 as shown in FIG. 25. As shown in FIGS. 6–10, the rolled portion holder 24 is mounted in front of a needle 211 of the stitching device 210.

The rolled portion holder 24 comprises as shown in FIG. 25 a side guide piece 24*c* to press the outer end of the rolled hem portion 42, an upper press piece 24*b* to press the hem portion 42 from above, and a pressing piece 24*a* mounted opposite to the side guide piece 24*c* as shown in FIG. 10. The rolled portion holder 24 encloses the rolled portion 41 and sends the rolled portion 41 under the needle 211 as shown in FIG. 25.

As shown in FIG. 25, the roiled portion holder 24 provides a complete rolled portion 41 by pressing the outer portion 42*a*, middle portion 42*b* and inner portion 42*c* with the upper press piece 24*b* when the first plate 12 and the second plate 13 no longer exist.

Figure 26:
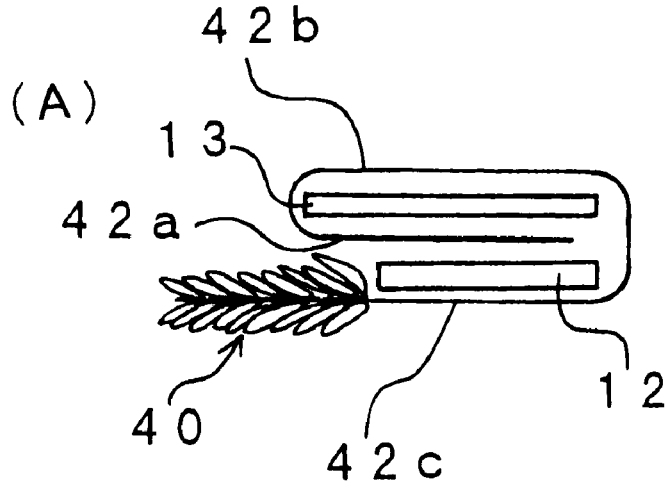
FIG. 26 schematically shows the configuration of the rolled hem portion provided in accordance with the process of the present invention, in which (A) shows the first plate and second plate sandwiched between the layers of the hem portion, and (B) shows the layered hem portion without the first and second plates.
Figure 26:
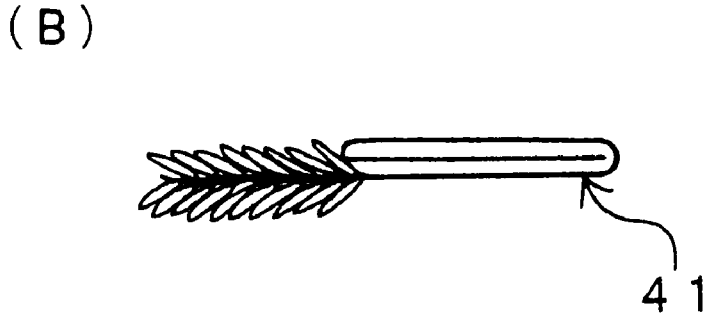
Figure 27:
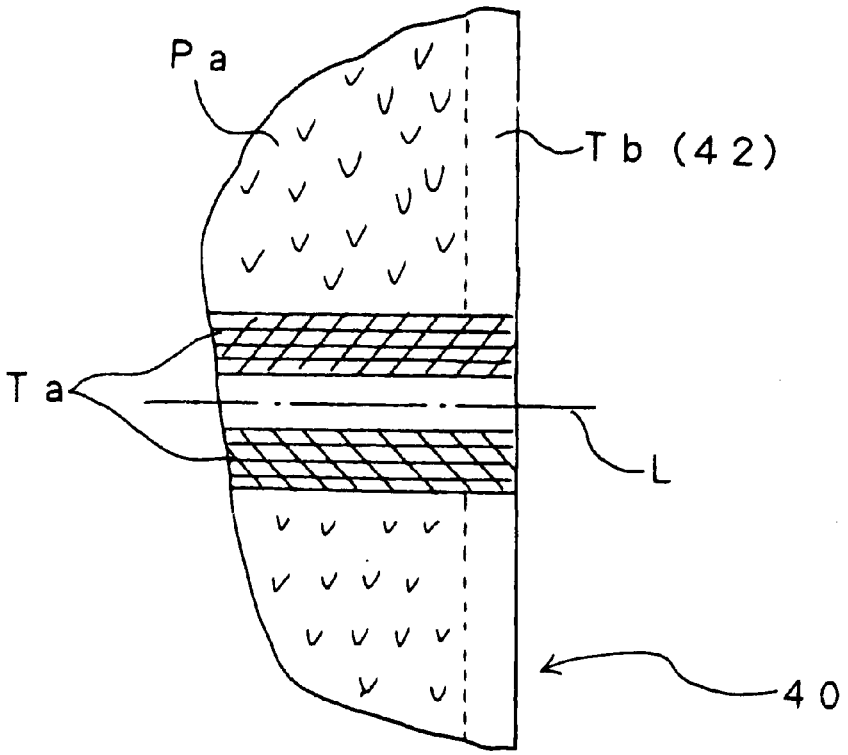
FIG. 27 shows a fabric material having an undulation along a hem, wherein (A) shows a portion of a towel fabric material and (B) shows the rolled hem portion.
Figure 27:
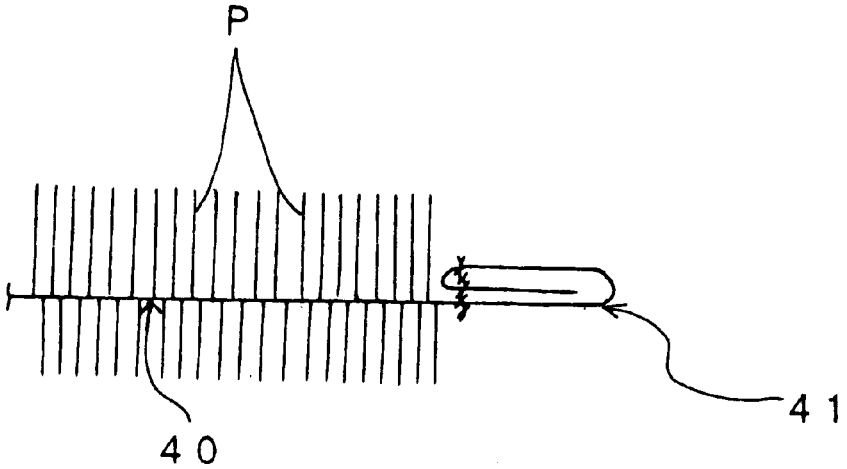
Figure 28:
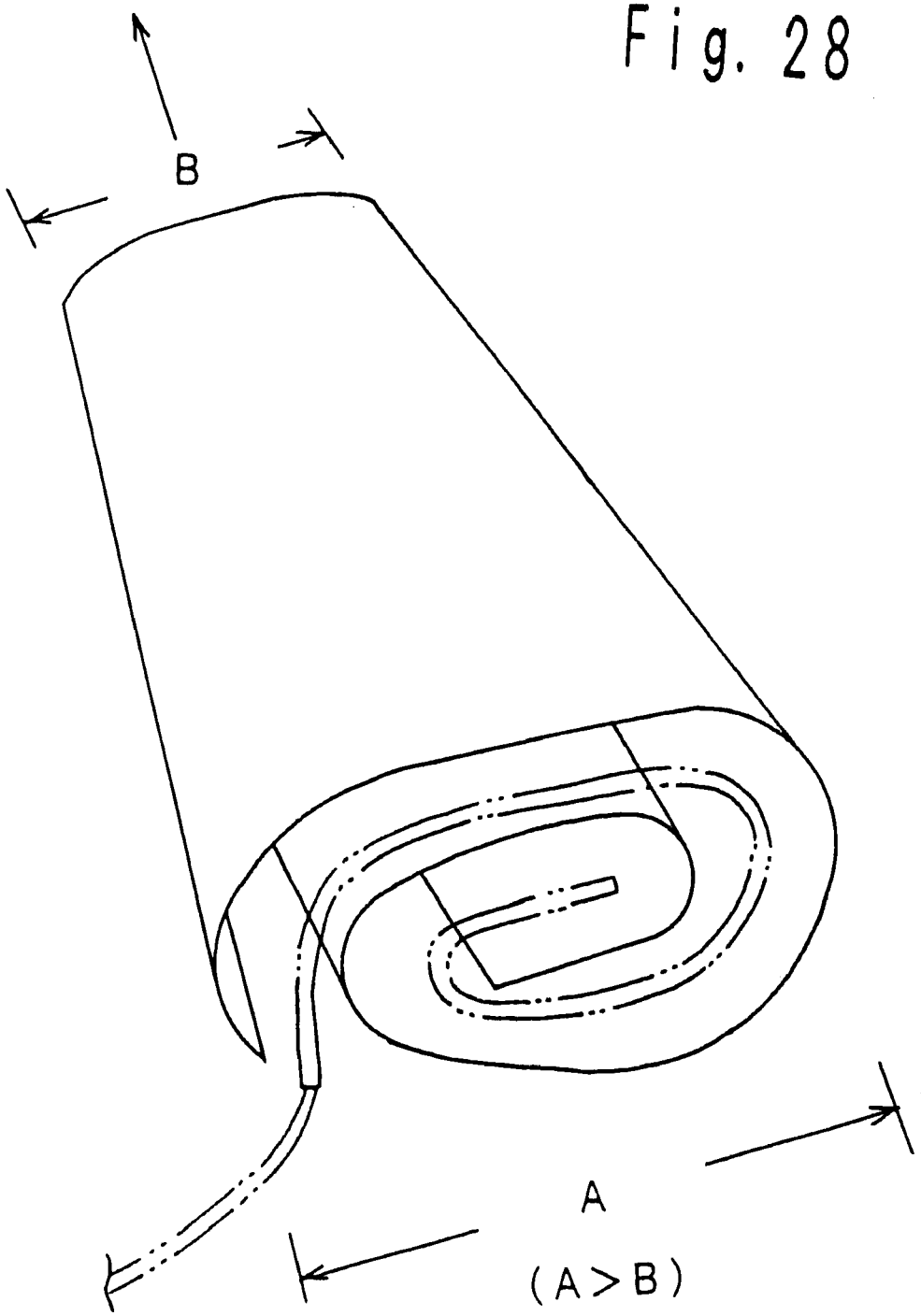
FIG. 28 is a perspective view of a conventional truncated multi-pipe device.

As shown in FIG. 26(A) , the width of the second plate 13 is slightly larger than that of the first plate 12, making the border between the outer portion 42*a* and the middle portion 42*b* protrude slightly toward the pile P when the rolled portion 41 assumes the configuration shown in FIG. 26(B), preventing the pile P from entering over the rolled portion 41 during stitching by the needle 211.

The rolled hem provider 100 is characterized by:

(1) a number of streaks extending from the proximal inner side to the distal outer side on the press surface 14 of the core body 11;

(2) a number of streaks extending from the proximal inner side to the distal outer side on the rail mounted under the core body 11:

(3) a number of slant or whirlpool streaks extending from the proximal underside to the distal upper side on the outer surface of the arc guide body 15;

(4) streaks provided such as the guide streaks 23*e* utilized in the bending device 23 on the surface of the rolling device 22 or either members forming the guide apparatus 20; and (5) utilization of selective combinations of measures 1–4.

The hem portion 42 will hold the rolled portion 41 through secure feeding of the hem portion 42 in the rolled hem provider 100.

Utility in the Industry:

As described above, the rolled hem portion forming process as claimed in claim 1 provides a rolled hem portion 41 from a hem portion 42 consisting of an outer portion 42*a*, middle portion 42*b* and inner portion 42*c* before sending the hem portion 42 to a stitching device 210, comprising the steps:

(1) rounding the outer portion 42*a* and middle portion 42*b* on an arc guide body 15 by a guide apparatus 21;

(2) further rounding the outer portion 42*a* and middle portion 42*b* on the arc guide body 15 by a rolling device 22;

(3) positioning a second plate 13 on the distal end of the arc guide body 15 within the outer portion 42*a* and middle portion 42*b;*

(4) foiling the outer portion 42*a* onto the second plate 13 by a press piece; and (5) folding the outer portion 42*a* and middle portion 42*b* onto the inner portion 42*c* by a curved guide surface 13*a* of the second plate 13.

The process can adequately cope with a thin or thick, undulated or plain fabric, very smoothly and swiftly.

As explained, the process of the present invention is capable of forming a rolled hem portion on a thick and/or undulated fabric material utilizing an arc guide body 15 which may be a round bar. A rounded hem portion is prepared from an outer portion 42*a* and middle portion 42*b* of a hem portion 42. The outer portion 42*a* is then sent along a second plate 13 which provides a 90-degree twisted surface. Thereafter, the outer portion 42*a* and middle portion are layered and pressed on an inner portion 42*c* of the hem portion 42 to form a three-layered hem portion 41. Accordingly, stress in forming a rolled hem portion is greatly reduced, and a swift and secure forming of a rolled hem portion 41 is provided.

The device as claimed in claim 2 is a rolled hem provider 100 installed with a hemming apparatus 200 having a stitching device 210 to stitch a rolled portion 41 formed of an outer portion 42*a*, middle portion 42*b* and inner portion 42*c* of a hem portion 42 of an elongated fabric 40, comprising:

a roll core device 10 installed in parallel with the hem portion 42 and a guide apparatus 20 supported on a support table 30 around the core device 10 to send the hem portion 42 toward the core device 10:

the core device 10 comprising a core body 11 having a press surface 14 to press the inner portion 42*c* from above, an arc guide body 15 integrally provided on the core body 11 for providing an arc guide surface, a first plate 12 provided on the distal end of the core body 11, having a surface engaged with the press surface, and a second plate 13 provided in the center of the arc guide body 15, having a curved guide surface 13*a,* the guide apparatus 20 comprising a rounding plate 21 to fold the middle portion 42*b* toward the arc guide body 15, a rolling device 22 to further round the outer portion 42*a* toward the arc guide body 15, and a bending device 23 to fold the outer portion 42*a* along the second plate 13.

The rolled hem provider 100 as claimed in claim 2 can provide a rolled hem portion 41 securely and swiftly for stitching treatment by a stitching device 210.

The rolled hem provider 100 of the present invention is capable of coping with a hem portion 42 of a fabric material which may be undulated and/or thick adequately and speedily. The roll core device 10 is a separate member from the guide apparatus 20, which facilitates easier maintenance and replacement of the core device 10 and guide apparatus 20.

That is claimed is:

1. A process to form a three-layer rolled portion (41) on a hem portion (42) of an elongated fabric material (40) consisting of an outer portion (42*a*), middle portion (42*b*) and inner portion (42*c*) for further processing by a stitching device (210), comprising the steps:

(a) rounding said outer portion (42*a*) and middle portion (42*b*) on an arc guide body (15) having an arc guide surface with a rounding plate (21);

(b) further rounding said outer portion (42*a*) and middle portion (42*b*) on said arc guide body (15) with a rolling device (22);

(c) positioning a second plate (13) arranged on an end of said arc qiide body (15) within said outer portion (42*a*) and middle portion (42*b*);

(d) folding said outer portion (42*a*) onto said second plate (13) with a bending device (23); and (e) frolding said outer portion (42*a*) and middle portion (42*b*) onto said inner portion (42*c*) with a curved guide surface (13*a*) of said second plate (13).

2. A rolled hem provider (100) for a hemming apparatus (200) to form a rolled portion (41) on a hem portion (42) of an elongated fabric material (40) consisting of an outer portion (42*a*), middle portion (42*b*) and inner portion (42*c*) for further processing by a stitching device (210), comprising:

a roll core device (10) provided in parallel with a hem portion (42) of an elongated fabric material (40); and a guide apparatus (20) mounted around said core device (10) via a support table (30) to guide said hem portion (42) toward said core device (10), wherein said roll core device (10) comprises a core body (11) having a press surface (14) to press said inner portion (42*c*) of said lem portion (42) from above, an arc guide body (15) integrally provided on said core body (11), having an arc guide surface, a first plate (12) integrally provided on said core body (11) having a pressing surface in engagement with said press surface (14), and a second plate (13), the first end thereof provided on a center of said arc guide body (15), having a right angle with said press surface (14), and the second end thereof having a curved guide surface (13*a*) substantially in parallel with said press surface (14), wherein said guide apparatus (20) comprises a rounding plate (21) to round said middle portion (42*b*) of said hem portion (42) on said arc guide body (15), a rolling device (22) to further round said outer portion (42*a*) of said hem portion (42) on said arc guide body (15), and a bending device (23) to fold said outer portion (42*a*) along said second plate (13).

* * * * *